US007795199B2

(12) United States Patent
Molinaro et al.

(10) Patent No.: US 7,795,199 B2
(45) Date of Patent: Sep. 14, 2010

(54) STABLE ANTIMICROBIAL COMPOSITIONS INCLUDING SPORE, BACTERIA, FUNGI, AND/OR ENZYME

(75) Inventors: Katherine J. Molinaro, Inver Grove Heights, MN (US); Daniel E. Pedersen, Cottage Grove, MN (US); Joshua P. Magnuson, St. Paul, MN (US); Michael E. Besse, Golden Valley, MN (US); Jaclyn Steep, Woodbury, MN (US); Victor F. Man, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 910 days.

(21) Appl. No.: 11/381,854

(22) Filed: May 5, 2006

(65) Prior Publication Data

US 2006/0247150 A1 Nov. 2, 2006

Related U.S. Application Data

(63) Continuation-in-part of application No. 10/956,135, filed on Oct. 1, 2004, and a continuation-in-part of application No. 10/208,404, filed on Jul. 29, 2002, now Pat. No. 7,553,806, which is a continuation-in-part of application No. 09/606,478, filed on Jun. 29, 2000, now Pat. No. 6,624,132.

(60) Provisional application No. 60/678,472, filed on May 5, 2005, provisional application No. 60/514,370, filed on Oct. 24, 2003.

(51) Int. Cl.

| | |
|---|---|
| ***C11D 1/66*** | (2006.01) |
| ***C11D 1/82*** | (2006.01) |
| ***C11D 3/04*** | (2006.01) |
| ***C11D 3/30*** | (2006.01) |
| ***C11D 3/386*** | (2006.01) |

(52) U.S. Cl. ..... 510/238; 510/365; 510/384; 510/421; 510/422; 510/393; 510/466; 510/499; 510/504; 510/506; 134/39; 134/40; 134/42

(58) Field of Classification Search ..... 510/221, 510/238, 365, 393, 421, 422, 383, 466, 499, 510/506, 384, 504; 134/39, 40, 42
See application file for complete search history.

(56) References Cited

U.S. PATENT DOCUMENTS

| | | | | |
|---|---|---|---|---|
| 3,790,482 | A | | 2/1974 | Jones et al. |
| 3,929,678 | A | | 12/1975 | Laughlin et al. |
| 3,961,754 | A | | 6/1976 | Kuhns et al. |
| 4,211,517 | A | | 7/1980 | Schmid |
| 4,212,761 | A | | 7/1980 | Ciaccio |
| 4,238,345 | A | | 12/1980 | Guilbert |
| 4,243,543 | A | | 1/1981 | Guilbert et al. |
| 4,261,868 | A | | 4/1981 | Hora et al. |
| 4,462,922 | A | | 7/1984 | Boskamp |
| 4,481,167 | A | | 11/1984 | Ginter et al. |
| 4,537,706 | A | | 8/1985 | Severson, Jr. |
| 4,595,520 | A | | 6/1986 | Heile et al. |
| 4,608,189 | A | | 8/1986 | Koch et al. |
| 4,670,179 | A | | 6/1987 | Inamorato et al. |
| 4,680,134 | A | | 7/1987 | Heile et al. |
| 4,690,305 | A | | 9/1987 | Copeland |
| 4,749,508 | A | | 6/1988 | Cockrell, Jr. et al. |
| 4,826,661 | A | | 5/1989 | Copeland et al. |
| 4,836,951 | A | | 6/1989 | Totten et al. |
| 4,845,965 | A | | 7/1989 | Copeland et al. |
| 4,858,449 | A | | 8/1989 | Lehn |
| 4,877,459 | A | | 10/1989 | Cockrell, Jr. et al. |
| 4,983,315 | A | | 1/1991 | Glogowski et al. |
| 5,008,030 | A | * | 4/1991 | Cook et al. ..... 510/384 |
| 5,064,561 | A | | 11/1991 | Rouillard |
| 5,118,426 | A | | 6/1992 | Duncan et al. |
| 5,122,538 | A | | 6/1992 | Lokkesmoe et al. |
| 5,124,066 | A | | 6/1992 | Russell |
| 5,173,207 | A | | 12/1992 | Drapier et al. |
| 5,223,179 | A | | 6/1993 | Connor et al. |
| 5,234,719 | A | | 8/1993 | Richter et al. |
| 5,292,525 | A | | 3/1994 | Brenden et al. |
| 5,395,541 | A | | 3/1995 | Carpenter et al. |
| 5,407,700 | A | | 4/1995 | Man et al. |

(Continued)

FOREIGN PATENT DOCUMENTS

| | | |
|---|---|---|
| EP | 0 348 183 A3 | 12/1989 |

(Continued)

OTHER PUBLICATIONS

"Improvement in Slip Resistance/Coefficient of Friction in Field Tests using Wash 'n Walk™," *Technical Performance Bulletin*, Ecolab, 1 page (Dec. 18, 2003).
"Material Safety Data Sheet," Novozymes Biologicals, Inc., pp. 1-4 (Jan. 4, 2005).
"Novo Grease Guard. Grease Degrading Formulation with an Innovative BioS™," Novozymes, 4 pages (Nov. 1, 2004).
"Wash 'n Walk™. Real Customers. Real Results," 8 pages (Date Unknown).
Arledge, R., "Slip and Fall Survey for Applebee's Augusta Road," Liberty Mutual, pp. 1-10 (May 12, 2004).
Genencor International®, Purafect® MAL, Genencor® Alkaline Protease, Product Information, www.genencor.com, 2 pages (Nov. 2003).
*Hawley's Condensed Chemical Dictionary*, 12th Edition, Von Nostrand Reinhold Company, p. 176 (1993).
International Search Report dated Oct. 26, 2001.

(Continued)

*Primary Examiner*—Gregory R Del Cotto
(74) *Attorney, Agent, or Firm*—Andrew D. Sorensen; Laura C. DiLorenzo

(57) ABSTRACT

The present invention relates to a stable antimicrobial and cleaning compositions including an amine antimicrobial agent; a borate salt; and spores (bacterial or fungal), vegetative bacteria, fungi, or enzyme, and to methods of using the composition. The composition can also include a polyol.

3 Claims, No Drawings

U.S. PATENT DOCUMENTS

| | | | | |
|---|---|---|---|---|
| 5,449,619 | A | 9/1995 | Griffin et al. | |
| 5,451,336 | A | 9/1995 | Schwadtke et al. | |
| 5,494,817 | A | 2/1996 | Chen | |
| 5,571,446 | A | 11/1996 | Rouillard | |
| 5,578,134 | A | 11/1996 | Lentsch et al. | |
| 5,648,329 | A | 7/1997 | Blake et al. | |
| 5,797,986 | A * | 8/1998 | Rolando et al. | 134/6 |
| 5,851,973 | A | 12/1998 | Foley | |
| H1776 | H | 1/1999 | Lindard et al. | |
| 5,858,117 | A | 1/1999 | Oakes et al. | |
| 5,858,299 | A | 1/1999 | Fernholz et al. | |
| 5,858,941 | A | 1/1999 | Oakes et al. | |
| 5,861,366 | A | 1/1999 | Ihns et al. | |
| 5,863,882 | A | 1/1999 | Lin et al. | |
| 5,871,590 | A | 2/1999 | Hei et al. | |
| 5,876,514 | A | 3/1999 | Rolando et al. | |
| 5,883,062 | A | 3/1999 | Addison et al. | |
| 6,004,922 | A | 12/1999 | Watson et al. | |
| 6,008,178 | A | 12/1999 | Baillely et al. | |
| 6,015,781 | A | 1/2000 | Vinson et al. | |
| 6,017,864 | A | 1/2000 | Brittain et al. | |
| 6,017,872 | A * | 1/2000 | Pedersen et al. | 510/424 |
| 6,020,303 | A | 2/2000 | Cripe et al. | |
| 6,025,316 | A | 2/2000 | Cao et al. | |
| 6,046,150 | A | 4/2000 | Choy et al. | |
| 6,060,444 | A | 5/2000 | Schulz et al. | |
| 6,071,356 | A | 6/2000 | Olsen | |
| 6,121,219 | A * | 9/2000 | Herdt et al. | 510/218 |
| 6,150,324 | A | 11/2000 | Lentsch et al. | |
| 6,180,585 | B1 | 1/2001 | Schalitz et al. | |
| 6,191,092 | B1 | 2/2001 | Bragulla et al. | |
| 6,197,739 | B1 | 3/2001 | Oakes et al. | |
| 6,258,765 | B1 | 7/2001 | Wei et al. | |
| 6,339,054 | B1 | 1/2002 | Levitt et al. | |
| 6,350,607 | B1 | 2/2002 | Cooney, Jr. | |
| 6,376,451 | B1 | 4/2002 | Teasdale et al. | |
| 6,425,959 | B1 | 7/2002 | Man | |
| 6,506,261 | B1 * | 1/2003 | Man | 134/39 |
| 6,624,132 | B1 * | 9/2003 | Man et al. | 510/392 |
| 6,632,291 | B2 | 10/2003 | Rabon et al. | |
| 6,638,902 | B2 | 10/2003 | Tarara et al. | |
| 6,653,266 | B2 | 11/2003 | Wei et al. | |
| 6,673,760 | B1 | 1/2004 | Lentsch et al. | |
| 6,689,223 | B1 * | 2/2004 | Meine et al. | 134/2 |
| 6,900,167 | B2 | 5/2005 | Griese et al. | |
| 6,903,062 | B2 | 6/2005 | Griese et al. | |
| 2002/0173437 | A1 | 11/2002 | Rabon et al. | |
| 2002/0177541 | A1 | 11/2002 | Tarara et al. | |
| 2002/0182184 | A1 * | 12/2002 | Pearl et al. | 424/93.4 |
| 2003/0022806 | A1 | 1/2003 | Wei et al. | |
| 2003/0040458 | A1 | 2/2003 | Olson et al. | |
| 2003/0049832 | A1 * | 3/2003 | Tisinger et al. | 435/252.4 |
| 2003/0087787 | A1 * | 5/2003 | Man et al. | 510/392 |
| 2003/0126688 | A1 | 7/2003 | Peters et al. | |
| 2004/0072715 | A1 | 4/2004 | Griese et al. | |
| 2004/0106535 | A1 | 6/2004 | Wei et al. | |
| 2004/0121932 | A1 | 6/2004 | Griese et al. | |
| 2005/0020466 | A1 | 1/2005 | Man et al. | |
| 2005/0176618 | A1 * | 8/2005 | Biering et al. | 510/504 |
| 2006/0100122 | A1 * | 5/2006 | Baars et al. | 510/375 |

FOREIGN PATENT DOCUMENTS

| | | | |
|---|---|---|---|
| EP | 0 451 924 | A3 | 10/1991 |
| EP | 0 481 542 | A3 | 4/1992 |
| EP | 0 501 375 | A1 | 9/1992 |
| GB | 1 224 564 | | 3/1971 |
| GB | 2 140 818 | A | 12/1984 |
| GB | 2 200 132 | A | 7/1988 |
| GB | 2 271 120 | A | 4/1994 |
| NZ | 334912 | | 9/2000 |
| NZ | 500567 | | 5/2002 |
| WO | WO 93/21299 | | 10/1993 |
| WO | WO 95/00621 | | 1/1995 |
| WO | WO 96/06910 | | 3/1996 |
| WO | WO 96/41859 | | 12/1996 |
| WO | WO 97/02753 | | 1/1997 |
| WO | WO 97/05227 | | 2/1997 |
| WO | WO 97/07190 | | 2/1997 |
| WO | WO 98/54285 | | 12/1998 |
| WO | WO 99/47631 | | 9/1999 |

OTHER PUBLICATIONS

Morris, T. et al., "Formulating Liquid Detergents for Multiple Enzyme Stability," Cognis Corporation, Ambler, PA, www.Happi.com, pp. 92-98 (Jan. 2004).

Novozymes A/S, Detergent/2002-00806-01.pdf Application Sheet, Application of Savinase® Ultra & Alcalase® Ultra, pp. 1-6 (May 23, 2002).

Novozymes A/S, Detergent/2001-04366-04.pdf Application Sheet, Novozymes Proteases for Laundry Detergents, pp. 1-7 (May 24, 2002).

* cited by examiner

STABLE ANTIMICROBIAL COMPOSITIONS INCLUDING SPORE, BACTERIA, FUNGI, AND/OR ENZYME

CROSS REFERENCE TO RELATED APPLICATION

This application claims priority to U.S. Provisional Patent Application No. 60/678,472, filed May 5, 2005, the disclosure of which is incorporated herein by reference. This application is a continuation-in-part of application Ser. No. 10/208,404, filed Jul. 29, 2002 now U.S. Pat. No. 7,553,806, which is a continuation in part of Ser. No. 09/606,478, filed Jun. 29, 2000, now U.S. Pat. No. 6,624,132, issued Sep. 23, 2003, the disclosures of which are incorporated herein by reference. This application is a continuation-in-part of application Ser. No. 10/956,135, filed Oct. 1, 2004, which claims priority to U.S. Provisional Application No. 60/514,370, filed Oct. 24, 2003, the disclosures of which are incorporated herein by reference.

FIELD OF THE INVENTION

The present invention relates to a stable antimicrobial and cleaning compositions including an antimicrobial agent (e.g., amine antimicrobial agent); a borate salt; and spores (bacterial or fungal), vegetative bacteria, fungi, or enzyme, and to methods of using the composition. The composition can also include a polyol.

BACKGROUND OF THE INVENTION

Spores, bacteria, and fungi play an important role in cleaning compositions, particularly those used for cleaning drains and grease traps. Present cleaning compositions including spores, bacteria, fungi, or enzyme are typically provided as a "two-part" product, with one container of the biological component and a second container of the chemical cleaners. Mixing the chemical cleaners and the biological components and then storing the mixture is not possible due to adverse effects of the chemicals on the spores, bacteria, fungi, or enzyme. There remains a need for stable cleaning compositions (e.g., "one-part" compositions) including chemical cleaner, antimicrobial agent, and spores, bacteria, fungi, or enzyme.

SUMMARY OF THE INVENTION

The present invention relates to a stable antimicrobial and cleaning compositions including an antimicrobial agent (e.g., amine antimicrobial agent); a borate salt; and spores (bacterial or fungal), vegetative bacteria, fungi, or enzyme, and to methods of using the composition. The composition can also include a polyol.

In an embodiment, the present composition includes borate salt; amine antimicrobial agent; and an effective cleaning amount of spore, bacteria, fungi, or enzyme. The amine antimicrobial agent can include an aliphatic amine, an ether amine, or a diamine, or salt thereof. The borate salt can include an alkanol amine borate. The borate salt and/or the composition can be substantially free of sodium ions. In an embodiment, the present composition can provide a preparation including spores (bacterial or fungal), vegetative bacteria, fungi, or enzyme that has suitable stability at pH greater than or equal to 9. In an embodiment, the present composition can provide a preparation including spores (bacterial or fungal), vegetative bacteria, fungi, or enzyme that has suitable stability at up to about 65 wt-% water.

A cleaning composition according to the present invention can also include one or more of nonionic surfactant, silicone surfactant, anionic surfactant, and hydrotrope. The cleaning composition can include one or more of about 0.003 to about 35 wt-% nonionic surfactant, about 0.0005 to about 35 wt-% silicone surfactant, about 0.003 to about 35 wt-% anionic surfactant, and about 0.001 to about 20 wt-% hydrotrope. The cleaning composition can include nonionic surfactant and silicone surfactant. The cleaning composition can include about 0.5 to about 35 wt-% nonionic surfactant and about 0.1 to about 35 wt-% silicone surfactant.

The present method can include applying a composition according to the present invention to a surface or object to be cleaned. The composition applied can be a stabilized microbial or enzyme composition or a cleaning composition. The surface or object to be cleaned can include one or more of a floor, a drain, or a floor drain. In an embodiment, the present method can include increasing the coefficient of friction of a surface. In an embodiment, the present invention can include cleaning grout. In an embodiment, the surface or grout is a floor or flooring.

DETAILED DESCRIPTION OF THE INVENTION

Definitions

As used herein, microbial preparation refers to a composition including one or more of spores (bacterial or fungal), vegetative bacteria, fungi, or enzyme, which can be provided in a preservative. As used herein, bacteria preparation refers to a composition including bacterial spores and/or vegetative bacteria, which can be provided in a preservative. The preservative can include, for example, any or a variety of preservative compositions used in commercially supplied preparations of spores (bacterial or fungal), vegetative bacteria, fungi, or enzyme. Such preservatives can include, for example, chelator, surfactant, buffer, water, or the like. The microbial preparation can, for example, digest or degrade soils such as fat, oil, grease, sugar, protein, carbohydrate, or the like.

As used herein, weight percent (wt-%), percent by weight, % by weight, and the like are synonyms that refer to the concentration of a substance as the weight of that substance divided by the weight of the composition and multiplied by 100.

As used herein, boric acid salt and borate salt are used interchangeably to refer to a salt such as potassium borate, monoethanolamine borate, or another salt obtained by or that can be visualized as being obtained by neutralization of boric acid. The weight percent of a boric acid salt or borate salt in a composition of the present invention can be expressed either as the weight percent of either the negatively charged boron containing ion, e.g. the borate and/or boric acid moieties, or as the weight percent of the entire boric acid salt, e.g. both the negatively charged moiety and the positively charged moiety. Preferably, the weight percent refers to the entire boric acid salt. Weight percents of citric acid salts, or other acid salts, can also be expressed in these ways, preferably with reference to the entire acid salt. As used herein, the term "total boron compound" refers to the sum of borate and boric acid moieties.

As used herein, basic or alkaline pH refers to pH greater than 7, greater than or equal to 8, about 8 to about 9.5, about 8 to about 11, greater than about 9, or about 9 to about 10.5.

As used herein, substantially free of sodium ion refers to a composition including less than about 1 wt-% sodium ion.

Embodiments of compositions according to the present invention can include less than 1 wt-% sodium ion, less than 0.75 wt-% sodium ion, less than 0.5 wt-% sodium ion, less than 0.25 wt-% sodium ion, less than 0.2 wt-% sodium ion, less than 0.15 wt-% sodium ion, less than 0.1 wt-% sodium ion, less than 0.05 wt-% sodium ion. Each of these amounts can be modified by the term "about".

As used herein, the terms "flooring" or "floor" refer to any horizontal surface on which a person might walk. Flooring or a floor can be made of an inorganic material, such as ceramic tile or natural stone (e.g., quarry tile), or an organic material, such as an epoxy, a polymer, a rubber, or a resilient material. The flooring or floor can be in any of a variety of environments such as a restaurant (e.g., a fast food restaurant), a food processing and/or preparation establishment, a slaughter house, a packing plant, a shortening production plant, a kitchen, or the like.

As used herein, the phrases "coefficient of friction" and "slip resistance" can be defined with respect to any of a variety of standard publications, such as ASTM Standard D-2047, "Static Coefficient of Friction of Polish Coated Floor Surfaces as Measured by the James Machine" and a report by ASTM Committee D-21 which indicated that a floor having a coefficient of static friction of not less than 0.5 as measured by this test is recognized as providing a non-hazardous walkway surface. This value is qualified in NBS Technical Note 895 "An Overview of Floor Slip-Resistance, With Annotated Bibliography" by Robert J. Brungraber, wherein it is indicated that the value of 0.5 provides a factor of safety and that most people, taking normal strides, would be unlikely to slip on surfaces for which the value is greater than 0.3-0.35. Other relevant and similar standards include ANSI 1264.2-2001, ASTM C1028-89, ASTM D2047-93, ASTM F1679-00 (which relates to the English XL Tribometer), ASTM Test Method F1677-96, and UL 410 (1992). Each of the standards in this paragraph is incorporated herein by reference.

As used herein, the term "about" modifying the quantity of an ingredient in the compositions of the invention or employed in the methods of the invention refers to variation in the numerical quantity that can occur, for example, through typical measuring and material handling procedures used for making concentrates or use solutions in the real world; through inadvertent error in these procedures; through differences in the manufacture, source, or purity of the ingredients employed to make the compositions or carry out the methods; and the like. Whether or not modified by the term "about", the claims include equivalents to the quantities.

Stabilized Microbial and/or Enzyme Preparation

The present invention relates to a stabilized microbial and/or enzyme preparation including a borate salt; amine antimicrobial agent; and spores (bacterial or fungal), vegetative bacteria, fungi, or enzyme. The present stabilized composition can include, for example, antimicrobial agent (e.g., amine antimicrobial agent), and stabilized microbial preparation. The present stabilized composition can include, for example, solidification agent and stabilized enzyme preparation. The present stabilized composition can include, for example, solidification agent, stabilized microbial preparation, and stabilized enzyme preparation (e.g., stabilized microbial and enzyme preparation).

The microbial preparation can include, for example, spores or spore blend that can digest or degrade soils such as grease, oils (e.g., vegetable oils or animal fat), protein, carbohydrate, or the like. The microbial preparation can also produce enzymes that aid in the degradation of soils such as grease, oil, fat, protein, carbohydrate, or the like. The enzyme can include a detersive enzyme. The borate salt can include any of a variety of salts of boric acid, for example, certain alkali metal salts or alkanol amine salts. The boric acid salt can provide a source of alkalinity for a cleaning composition including the stabilized microbial preparation. The present invention also includes methods of using these compositions.

The boric acid salt can provide advantageous stability to the microbial preparation compared to conventional microbial preparation employed in, for example, cleaning compositions. Conventional microbial preparations that start with, for example, $10^4$ living bacteria or spores can, after four months, contain only $10^3$ or even only $10^2$ living organisms. That is, they lose one or two logs of active organisms, which can decrease the amount of soil removed, digested, or degraded. In an embodiment, the present stabilized microbial preparations lose less than one or two logs, or less than one log, of activity over 4 months. This provides a longer shelf life for the product containing the microbial preparation.

In an embodiment, the present stabilized microbial preparation is a component of a cleaning composition. Although not limiting to the present invention, the microbial preparation can be viewed as a source of detersive enzyme in the cleaning composition. Such a cleaning composition can also include additional enzymes, not produced by the microbial preparation in situ. The microbial preparation can produce, for example, enzymes such as proteases, lipases, and/or amylases. The composition can also include other added enzymes, such as, for example, proteases, lipases, and/or amylases. Although not limiting to the present invention, the added enzymes can be viewed as providing immediate cleaning upon application of the cleaning composition, and the microbial preparation can be viewed as providing persistent cleaning as the microbes remain on the article being cleaned, even after rinsing.

Most cleaners can only provide soil removal which is actually just moving the soil from one surface or location (e.g., a floor) to another (e.g., a drain). In certain embodiments, cleaning compositions including the present stabilized microbial preparation can provide both soil removal and persistent soil reduction, through persistent enzymatic breakdown of soils. Cleaning compositions including the present stabilized microbial preparations can be used for a variety of purposes, including as a floor cleaner, as a grout cleaner, as a combination floor and drain cleaner and degreaser/grease digester, as a grease digester in grease traps, for effluent and/or wastewater treatment (e.g., reduction of fats, oils, and greases), in municipal waste treatment, as a grease digester in rendering plants, or for black and gray water treatment on cruise ships.

The present composition can include a stabilized enzyme preparation including a borate salt and enzyme. The enzyme can be a detersive enzyme. The enzyme preparation can include, for example, enzyme or enzyme blend that can digest or degrade soils such as grease, oils (e.g., vegetable oils or animal fat), protein, carbohydrate, or the like. The borate salt can include any of a variety of salts of boric acid, for example, alkali metal salts or alkanol amine salts. The boric acid salt can provide a source of alkalinity for a cleaning composition including the stabilized enzyme preparation.

The boric acid salt can provide advantageous stability to the enzyme preparation compared to a conventional enzyme preparation employed in, for example, cleaning compositions. This stability can be manifest, for example, in the composition as a concentrate or at a use dilution Cleaning compositions including the present stabilized enzyme preparations can be used for a variety of purposes, including as a floor cleaner, as a grout cleaner, as a combination floor and drain cleaner and degreaser/grease digester, as a grease digester in grease traps, for effluent and/or wastewater treatment (e.g., reduction of fats, oils, and greases), in municipal waste treatment, as a grease digester in rendering plants, or for black and gray water treatment on cruise ships.

Although not limiting to the present invention, it is believed that the present stable microbial or enzyme compositions can break down grease or oil on a surface. Breaking down the grease or oil can release other soil stuck in the grease or oil. Accordingly, the present composition can clean a surface. In an embodiment, the present invention includes a method including repeating application of the present stable microbial composition. For example, the present method can include daily application. Application for five to 14 days can clean a lightly soiled surface. Application for three to six weeks can clean a heavily soiled surface.

Boric Acid Salts

The present invention relates to a stable microbial cleaning composition that employs one or more boric acid salts to provide improved stability of the microbial preparation, even at basic pH. Suitable boric acid salts can provide alkalinity to the stable microbial cleaning solution. Such salts include alkali metal boric acid salts; amine boric acid salts, preferably alkanolamine boric acid salts; and the like; or a combination thereof. In certain embodiments, the boric acid salt includes potassium borate, monoethanolammonium borate, diethanolammonium borate, triethanolammonium borate, and the like, or a combination thereof. In an embodiment, the boric acid salt includes monoethanolamine borate.

The boric acid salt, e.g. potassium or monoethanolamine borate, can be obtained by any of a variety of routes. For example, commercially available boric acid salt, e.g. potassium borate, can be added to the composition. Alternatively, the boric acid salt, e.g. potassium or monoethanolamine borate, can be obtained by neutralizing boric acid with a base, e.g. a potassium containing base such as potassium hydroxide or a base such as monoethanolamine.

In certain embodiments, the boric acid salt is soluble in the composition of the invention at concentrations in excess of 5 or 10 wt-%, e.g., in excess of 11, 12, 13, 14, 15, 16, 17, 18, 19, or 20 wt-%. The boric acid salt used in the present compositions can be employed at a maximum concentration up to its solubility limit. In certain embodiments, the boric acid salt can be soluble in the composition of the invention at concentrations up to 35 wt-%, e.g., up to 25, 30, or 35 wt-%. In certain embodiments, the boric acid salt can be soluble at 12-35 wt-%, 15-30 wt-%, or 20-25 wt-%, preferably 20-25 wt-%. The present compositions can also include any of the quantities or ranges of boric acid salt modified by the term "about".

In an embodiment, alkanol amine borates, such as monoethanolamine borate, are soluble at concentrations larger than other boric acid salts, particularly sodium borate. Alkanol amine borates, such as monoethanolamine borate, can be employed and soluble in the present cleaning compositions at concentrations listed above, preferably up to about 30 weight percent, preferably about 20 to about 25 weight percent. In an embodiment, this high solubility can be obtained at alkaline pH, such as pH about 9 to about 10.5.

In an embodiment, potassium borate is soluble at concentrations larger than other metal boric acid salts, particularly other alkali metal boric acid salts, particularly sodium borate. Potassium borate can be employed and soluble in the present enzyme cleaning compositions at concentrations listed above, preferably up to about 25 weight percent, preferably about 15 to about 25 weight percent. In an embodiment, this high solubility can be obtained at alkaline pH, such as pH about 9 to about 10.5.

The boric acid salt can provide desirable increases in microbial preparation stability at basic pH compared to other buffer systems suitable for maintaining a pH above about 7, above about 8, about 8 to about 11, or about 9 to about 10.5. Maintaining alkaline pH can provide greater cleaning power.

The present stable bacteria composition can be substantially free of sodium ion. Advantageously, in compositions substantially free of sodium ion, borate salts are soluble at concentrations larger than in the presence of sodium ion. Unfortunately, sodium ion is a common counter ion for salts. Therefore, care must be taken to provide compositions according to the present invention that are substantially free of sodium ion. For example, substantially sodium ion free compositions according to the present invention can be made from acid forms of reagents, which are neutralized, as appropriate, by an alkanol amine or potassium hydroxide. For example, substantially sodium ion free compositions according to the present invention can be made from salts other than sodium salts, e.g. potassium or alkanol amine salts. In an embodiment, the present compositions include sodium ion at a level at which sodium borate does not precipitate from the composition. One way to achieve such low levels of sodium is to exclude sodium salts from the composition or to exclude sodium salts except for the amphoteric surfactant. Preferably, even with sodium from an amphoteric surfactant the composition of the present invention is substantially free of sodium ion. The present substantially sodium ion free cleaning compositions can include borate salts at concentrations up to about 35 weight percent, e.g., about 15 to about 30 weight percent. In an embodiment, this high solubility can be obtained at alkaline pH, such as pH about 9 to about 10.5.

Compositions including borate salts and substantially free of sodium ion can provide desirable increases in microbial preparation stability at basic pH compared to other buffer systems suitable for maintaining a pH above about 7, above about 8, of about 8 to about 11, or of about 9 to about 10.5. Maintaining alkaline pH can provide greater cleaning power.

In certain embodiments, alkanolamine borate is present at about 5 to about 35 wt-%, at about 10 wt-% to about 30 wt-%, at about 10 wt-% to about 20 wt-%, at about 5 wt-% to about 15 wt-%, or at about 15 wt-% to about 25 wt-%. In certain embodiments, alkanolamine borate is present at about 5 wt-%, at about 10 wt-%, at about 15 wt-%, at about 20 wt-%, at about 25 wt-%, or at about 30 wt-% of the composition. Such a formulation can be substantially free of sodium ion. The present compositions can also include any of the quantities or ranges of monoethanolamine borate not modified by the term "about".

In certain embodiments, monoethanolamine borate is present at about 10 wt-% to about 30 wt-% of the composition, at about 10 wt-% to about 20 wt-%, at about 5 wt-% to about 15 wt-%, or at about 15 wt-% to about 25 wt-%. In certain embodiments, monoethanolamine borate is present at about 5 wt-%, at about 10 wt-%, at about 15 wt-%, at about 20 wt-%, at about 25 wt-%, or at about 30 wt-% of the composition. Such a formulation can be substantially free of sodium ion. The present compositions can also include any of the quantities or ranges of monoethanolamine borate not modified by the term "about".

In certain embodiments, the boric acid salt is present at about 5 to about 35 wt-%, at about 10 wt-% to about 30 wt-%, at about 10 wt-% to about 20 wt-%, at about 5 wt-% to about 15 wt-%, or at about 15 wt-% to about 25 wt-%. In certain embodiments, boric acid salt is present at about 5 wt-%, at about 10 wt-%, at about 15 wt-%, at about 20 wt-%, at about 25 wt-%, or at about 30 wt-% of the composition. Such a formulation can be substantially free of sodium ion. The present compositions can also include any of the quantities or ranges of boric acid salt not modified by the term "about".

Microbial Preparations

Any of a variety of spores (bacterial or fungal), vegetative bacteria, fungi, or enzyme can be employed in the present stabilized bacterial compositions. For example, the present composition can include any viable microorganism or mixture thereof that can survive the formulation and the intended use environment or that can digest, degrade, or promote the degradation of lipids, proteins, carbohydrates, other organic matter, or the like common to domestic, institutional, and industrial soil or effluent, or the like. Many suitable strains and species are known.

Suitable spores (bacterial or fungal), vegetative bacteria, fungi, or enzyme include *Bacillus, Pseudomonas, Arthrobacter, Enterobacter, Citrobacter, Corynebacter, Nitrobacter*, mixtures thereof, or the like; *Acinetobacter, Aspergillus, Azospirillum, Burkholderia, Ceriporiopsis, Escherichia, Lactobacillus, Paenebacillus, Paracoccus, Rhodococcus, Syphingomonas, Streptococcus, Thiobacillus, Trichoderma, Xanthomonas, Lactobacillus, Nitrosomonas, Alcaliaens, Klebsiella*, mixtures thereof, or the like; mixtures thereof, or the like.

Suitable *Bacillus* include *Bacillus licheniformis, Bacillus subtilis, Bacillus polymyxa*, or the like; *Bacillus methanolicus, Bacillus amyloliquefaciens, Bacillus pasteurii, Bacillus laevolacticus, Bacillus megaterium*, mixtures thereof, or the like; mixtures thereof, or the like. Suitable *Pseudomonas* include *Pseudomonas aeruginosa, Pseudomonas alkanolytica, Pseudomonas dentrificans*, mixtures thereof, or the like. Suitable *Arthrobacter* include *Arthrobacter paraffineus, Arthrobacter petroleophagus, Arthrobacter rubellus, Arthrobacter* sp., mixtures thereof, or the like. Suitable *Enterobacter* include *Enterobacter cloacae, Enterobacter* sp., mixtures thereof, or the like. Suitable *Citrobacter* include *Citrobacter amalonaticus, Citrobacter freundi*, mixtures thereof, or the like. Suitable *Corynebacterium* include *Corynebacterium alkanum, Corynebacterium fujiokense, Corynebacterium hydrocarbooxydano, Corynebacterium* sp. mixtures thereof, or the like.

Suitable spores (bacterial or fungal), vegetative bacteria, fungi, or enzyme include those with ATCC accession nos. 21417, 21424, 27811, 39326, 6051a, 21228, 21331, 35854, 10401, 12060, 21551, 21993, 21036, 29260, 21034, 13867, 15590, 21494, 21495, 21908, 962, 15337, 27613, 33241, 25405, 25406, 25407, 29935, 21194, 21496, 21767, 53586, 55406, 55405, 55407, 23842, 23843, 23844, 23845, 6452, 6453, 11859, 23492, mixtures thereof, or the like.

Suitable microorganisms that can be used in the present invention include those disclosed in U.S. Pat. Nos. 4,655,794, 5,449,619, and 5,863,882; and U.S. Patent Application Publication Nos. 20020182184, 20030126688, and 20030049832; the disclosures of which are incorporated herein by reference.

Suitable spores (bacterial or fungal), vegetative bacteria, fungi, or enzyme are commercially available from a variety of sources (e.g., Sybron Chemicals, Inc., Semco Laboratories, Inc., or Novozymes). Tradenames for such products include SPORZYME® 1B, SPORZYME® Ultra Base 2, SPORZYME® EB, SPORZYME® BCC, SPORZYME® WC Wash, SPORZYME® FE, BI-CHEM® MSB, BI-CHEM Purta Treat, BI-CHEM® BDO, BI-CHEM® SANI-BAC®, BI-CHEM® BIO-SCRUB®, BI-CHEM® GC600L®, BI-CHEM® Bioclean, GREASE GUARD®, or the like.

In an embodiment, the spores (bacterial or fungal), vegetative bacteria, fungi, or enzyme include strains of *Bacillus* specifically adapted for high production of extracellular enzymes, particularly proteases, amylases and cellulases. Such strains are common in waste treatment products. This mixture can include *Bacillus licheniformis, Bacillus subtilis* and *Bacillus polymyxa*. By way of further example, *Bacillus pasteurii* can exhibit high levels of lipase production; *Bacillus laevolacticus* can exhibit a faster germination cycle; *Bacillus amyloliquefaciens* can exhibit high levels of protease production.

Suitable concentrations for the spores (bacterial or fungal), vegetative bacteria, fungi, or enzyme in the formula include about $1\times10^3$ to about $1\times10^9$ CFU/mL, about $1\times10^4$ to $1\times10^8$ CFU/mL, about $1\times10^5$ CFU/mL to $1\times10^7$ CFU/mL, or the like. Commercially available compositions of spores (bacterial or fungal), vegetative bacteria, fungi, or enzyme can be employed in the present compositions at effective cleaning compositions, for example, about 0.5 to about 10 wt-%, about 1 to about 5 (e.g., 4) wt-%, about 2 to about 10 wt-%, about 1 to about 3 wt-%, or about 2 wt-%. The present composition can include these amounts or ranges not modified by about.

Embodiments of Stabilized Microbial Preparation

In an embodiment, the present stabilized microbial preparations including the microbial preparation (e.g., bacterial preparation, such as spore blend), boric acid salt (e.g., alkanol amine borate, such as monoethanolamine borate), and optional polyol (e.g., propylene glycol). In certain embodiments, the present stabilized microbial preparations include about 2 to about 40 wt-% boric acid salt, about 3 to about 15 wt-% boric acid salt, about 5 to about 30 wt-% boric acid salt, about 5 to about 25 wt-% boric acid salt, about 5 to about 10 wt-% boric acid salt, about 10 to about 15 wt-% boric acid salt, or about 25 to about 30 wt-% boric acid salt. In certain embodiments, the present composition includes about 2 to about 30 wt-% polyol, about 2 to about 10 wt-% polyol, about 5 to about 20 wt-% polyol, about 5 to about 10 wt-% polyol, or about 10 to about 20 wt-% polyol. In certain embodiments, the present stabilized microbial preparations include about 2 to about 40 wt-% polyol, about 2 to about 20 wt-% polyol, about 2 to about 15 wt-% polyol, about 2 to about 10 wt-% polyol, about 3 to about 10 wt-% polyol, about 4 to about 15 wt-% polyol, or about 4 to about 8 wt-% polyol, about 4 wt-% polyol, about 8 wt-% polyol, or about 12 wt-% polyol. In certain embodiments, the present stabilized microbial preparations include about 10 to about 95 wt-% water, about 15 to about 75 wt-% water, about 15 to about 35 wt-% water, about 25 to about 75 wt-% water, about 40 to about 70 wt-% water, about 45 to about 65 wt-% water, or up to about 50, about 55, about 60, about 65, or about 70 wt-% water.

In an embodiment, the present cleaning composition includes spore, bacteria, fungi, or enzyme; and alkanol amine borate. In an embodiment, the composition can have pH greater than or equal to 9, e.g., about 9 to about 10.5. In an embodiment, the composition can have pH greater than or equal to 8, e.g., about 8 to about 9.5. The composition can also include polyol. In an embodiment, the polyol can include propylene glycol. The composition can also include up to about 65 wt-% water.

In an embodiment, the alkanol amine borate can include monoethanolammonium borate, diethanolammonium borate, triethanolammonium borate, or a combination thereof. The composition can include about 5 to about 35 wt-% alkanol amine borate, about 10 to about 30 wt-% alkanol amine borate, or about 15 to about 25 wt-% alkanol amine borate.

In an embodiment, the present cleaning composition includes spore, bacteria, fungi, or enzyme; and borate salt, and can be substantially free of sodium ion. The composition can have pH greater than or equal to 9, e.g., about 9 to about 10.5. The composition can also include polyol. In an embodiment, the polyol can include propylene glycol. The composition can also include up to about 65 wt-% water.

The boric acid salt can include potassium borate. The potassium borate can include a combination of potassium hydroxide and boric acid. The composition can include about 5 to about 35 wt-% borate salt, about 10 to about 30 wt-% borate salt, or about 15 to about 25 wt-% borate salt.

In an embodiment, the spore or bacteria can include bacterial spore.

Enzymes

The present cleaning composition can include one or more enzymes, which can provide desirable activity for removal of protein-based, carbohydrate-based, or triglyceride-based stains from substrates; for cleaning, destaining, and presoaks. Although not limiting to the present invention, enzymes suitable for the present cleaning compositions can act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

"Detersive enzyme", as used herein, means an enzyme having a cleaning, destaining or otherwise beneficial effect as a component of a composition for laundry, textiles, warewashing, cleaning-in-place, drains, floors, carpets, medical or dental instruments, meat cutting tools, hard surfaces, personal care, or the like. Suitable detersive enzymes include a hydrolase such as a protease, an amylase, a lipase, or a combination thereof.

Enzymes are normally incorporated into a composition according to the invention in an amount sufficient to yield effective cleaning during a washing or presoaking procedure. An amount effective for cleaning refers to an amount that produces a clean, sanitary, and, preferably, corrosion free appearance to the material cleaned. An amount effective for cleaning also can refer to an amount that produces a cleaning, stain removal, soil removal, whitening, deodorizing, or freshness improving effect on substrates. Typically such a cleaning effect can be achieved with amounts of enzyme from about 0.1% to about 3% by weight, preferably about 1% to about 3% by weight, of the cleaning composition. Higher active levels may also be desirable in highly concentrated cleaning formulations.

Commercial enzymes, such as alkaline proteases, are obtainable in liquid or dried form, are sold as raw aqueous solutions or in assorted purified, processed and compounded forms, and include about 2% to about 80% by weight active enzyme generally in combination with stabilizers, buffers, cofactors, impurities and inert vehicles. The actual active enzyme content depends upon the method of manufacture and is not critical, assuming the composition has the desired enzymatic activity. The particular enzyme chosen for use in the process and products of this invention depends upon the conditions of final utility, including the physical product form, use pH, use temperature, and soil types to be digested, degraded, or altered. The enzyme can be chosen to provide optimum activity and stability for any given set of utility conditions.

The compositions of the present invention preferably include at least a protease. The composition of the invention has further been found, surprisingly, not only to stabilize protease for a substantially extended shelf life, but also to significantly enhance protease activity toward digesting proteins and enhancing soil removal. Further, enhanced protease activity occurs in the presence of one or more additional enzymes, such as amylase, cellulase, lipase, peroxidase, endoglucanase enzymes and mixtures thereof, preferably lipase or amylase enzymes.

The enzyme can be selected for the type of soil targeted by the cleaning composition or present at the site or surface to be cleaned. Although not limiting to the present invention, it is believed that amylase can be advantageous for cleaning soils containing starch, such as potato, pasta, oatmeal, baby food, gravy, chocolate, or the like. Although not limiting to the present invention, it is believed that protease can be advantageous for cleaning soils containing protein, such as blood, cutaneous scales, mucus, grass, food (e.g., egg, milk, spinach, meat residue, tomato sauce), or the like. Although not limiting to the present invention, it is believed that lipase can be advantageous for cleaning soils containing fat, oil, or wax, such as animal or vegetable fat, oil, or wax (e.g., salad dressing, butter, lard, chocolate, lipstick). Although not limiting to the present invention, it is believed that cellulase can be advantageous for cleaning soils containing cellulose or containing cellulose fibers that serve as attachment points for other soil.

A valuable reference on enzymes is "Industrial Enzymes", Scott, D., in *Kirk-Othmer Encyclopedia of Chemical Technology,* 3rd Edition, (editors Grayson, M. and EcKroth, D.) Vol. 9, pp. 173-224, John Wiley & Sons, New York, 1980.

Protease

A protease suitable for the composition of the present invention can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). A preferred protease is neither inhibited by a metal chelating agent (sequestrant) or a thiol poison nor activated by metal ions or reducing agents, has a broad substrate specificity, is inhibited by diisopropylfluorophosphate (DFP), is an endopeptidase, has a molecular weight in the range of about 20,000 to about 40,000, and is active at a pH of about 6 to about 12 and at temperatures in a range from about 20° C. to about 80° C.

Examples of proteolytic enzymes which can be employed in the composition of the invention include (with trade names) Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Preferred commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like. A mixture of such proteases can also be used. For example, Purafect® is a preferred alkaline protease (a subtilisin) for use in detergent compositions of this invention having application in lower temperature cleaning programs, from about 30° C. to about 65° C.; whereas, Esperase® is an alkaline protease of choice for higher temperature detersive solutions, from about 50° C. to about 85° C. Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present compositions is preferably at least 80% homologous, preferably having at least 80% sequence identity, with the amino acid sequences of the proteases in these references.

In preferred embodiments of this invention, the amount of commercial alkaline protease present in the composition of the invention ranges from about 0.1% by weight of detersive solution to about 3% by weight, preferably about 1% to about 3% by weight, preferably about 2% by weight, of solution of the commercial enzyme product. Typical commercially available detersive enzymes include about 5-10% of active enzyme.

Whereas establishing the percentage by weight of commercial alkaline protease required is of practical convenience for manufacturing embodiments of the present teaching, variance in commercial protease concentrates and in-situ environmental additive and negative effects upon protease activity require a more discerning analytical technique for protease assay to quantify enzyme activity and establish correlations to soil residue removal performance and to enzyme stability within the preferred embodiment; and, if a concentrate, to use-dilution solutions. The activity of the proteases for use in the present invention are readily expressed in terms of activity units—more specifically, Kilo-Novo Protease Units (KNPU) which are azocasein assay activity units well known to the art. A more detailed discussion of the azocasein assay procedure can be found in the publication entitled "The Use of Azoalbumin as a Substrate in the Colorimetric Determination of Peptic and Tryptic Activity", Tomarelli, R. M., Charney, J., and Harding, M. L., *J. Lab. Clin. Chem.* 34, 428 (1949).

In preferred embodiments of the present invention, the activity of proteases present in the use-solution ranges from about $1\times10^{-5}$ KNPU/gm solution to about $4\times10^{-3}$ KNPU/gm solution.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

Amylase

An amylase suitable for the composition of the present invention can be derived from a plant, an animal, or a microorganism. Preferably the amylase is derived from a microorganism, such as a yeast, a mold, or a bacterium. Preferred amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed in the composition of the invention include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include the stability enhanced variant amylase sold under the trade name Duramyl by Novo. A mixture of amylases can also be used.

Amylases suitable for the compositions of the present invention include: α-amylases described in WO 95/26397, PCT/DK96/00056, and GB 1,296,839 to Novo; and stability enhanced amylases described in J. Biol. Chem., 260(11): 6518-6521 (1985); WO 9510603 A, WO 9509909 A and WO 9402597 to Novo; references disclosed in WO 9402597; and WO 9418314 to Genencor International. A variant α-amylase employed in the present compositions can be at least 80% homologous, preferably having at least 80% sequence identity, with the amino acid sequences of the proteins of these references.

Suitable amylases for use in the compositions of the present invention have enhanced stability compared to certain amylases, such as Termamyl®. Enhanced stability refers to a significant or measurable improvement in one or more of: oxidative stability, e.g., to hydrogen peroxide/tetraacetylethylenediamine in buffered solution at pH 9-10; thermal stability, e.g., at common wash temperatures such as about 60° C.; and/or alkaline stability, e.g., at a pH from about 8 to about 11; each compared to a suitable control amylase, such as Termamyl®. Stability can be measured by methods known to those of skill in the art. Suitable enhanced stability amylases for use in the compositions of the present invention have a specific activity at least 25% higher than the specific activity of Termamyl® at a temperature in a range of 25° C. to 55° C. and at a pH in a range of about 8 to about 10. Amylase activity for such comparisons can be measured by assays known to those of skill in the art and/or commercially available, such as the Phadebas® α-amylase assay.

In an embodiment, the amount of commercial amylase present in the composition of the invention ranges from about 0.1% by weight of detersive solution to about 3% by weight, preferably about 1% to about 3% by weight, preferably about 2% by weight, of solution of the commercial enzyme product.

Typical commercially available detersive enzymes include about 0.25-5% of active amylase.

Whereas establishing the percentage by weight of amylase required is of practical convenience for manufacturing embodiments of the present teaching, variance in commercial amylase concentrates and in-situ environmental additive and negative effects upon amylase activity may require a more discerning analytical technique for amylase assay to quantify enzyme activity and establish correlations to soil residue removal performance and to enzyme stability within the embodiment; and, if a concentrate, to use-dilution solutions. The activity of the amylases for use in the present invention can be expressed in known units or through known amylase assays and/or commercially available assays, such as the Phadebas® α-amylase assay.

Naturally, mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme.

Cellulases

A cellulase suitable for the composition of the present invention can be derived from a plant, an animal, or a microorganism. The cellulase can be derived from a microorganism, such as a fungus or a bacterium. Suitable cellulases include those derived from a fungus, such as *Humicola insolens, Humicola* strain DSM 1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes that can be employed in the composition of the invention include those sold under the trade names Carezyme® or Celluzyme® by Novo, or Cellulase by Genencor; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo.

In an embodiment, the amount of commercial cellulase present in the composition of the invention ranges from about 0.1% by weight of detersive solution to about 3% by weight, preferably about 1% to about 3% by weight, of solution of the commercial enzyme product. Typical commercially available detersive enzymes include about 5-10 percent of active enzyme.

Whereas establishing the percentage by weight of cellulase required is of practical convenience for manufacturing embodiments of the present teaching, variance in commercial cellulase concentrates and in-situ environmental additive and negative effects upon cellulase activity may require a more discerning analytical technique for cellulase assay to quantify enzyme activity and establish correlations to soil residue removal performance and to enzyme stability within the embodiment; and, if a concentrate, to use-dilution solutions. The activity of the cellulases for use in the present invention can be expressed in known units or through known or commercially available cellulase assays.

Naturally, mixtures of different cellulase enzymes can be incorporated into this invention. While various specific enzymes have been described above, it is to be understood that any cellulase which can confer the desired cellulase activity to the composition can be used and this embodiment of this invention is not limited in any way by specific choice of cellulase enzyme.

Lipases

A lipase suitable for the composition of the present invention can be derived from a plant, an animal, or a microorganism. In an embodiment, the lipase is derived from a microorganism, such as a fungus or a bacterium. Suitable lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be employed in the composition of the invention include those sold under the trade names Lipase P "Amano" or "Amano-P" by Amano Pharmaceutical Co. Ltd., Nagoya, Japan or under the trade name Lipolase® by Novo, and the like. Other commercially available lipases that can be employed in the present compositions include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*.

A suitable lipase is sold under the trade name Lipolase® by Novo. Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

In an embodiment, the amount of commercial lipase present in the composition of the invention ranges from about 0.1% by weight of detersive solution to about 3% by weight, preferably about 1% to about 3% by weight, of solution of the commercial enzyme product. Typical commercially available detersive enzymes include about 5-10 percent of active enzyme.

Whereas establishing the percentage by weight of lipase required is of practical convenience for manufacturing embodiments of the present teaching, variance in commercial lipase concentrates and in-situ environmental additive and negative effects upon lipase activity may require a more discerning analytical technique for lipase assay to quantify enzyme activity and establish correlations to soil residue removal performance and to enzyme stability within the embodiment; and, if a concentrate, to use-dilution solutions. The activity of the lipases for use in the present invention can be expressed in known units or through known or commercially available lipase assays.

Naturally, mixtures of different lipase enzymes can be incorporated into this invention. While various specific enzymes have been described above, it is to be understood that any lipase which can confer the desired lipase activity to the composition can be used and this embodiment of this invention is not limited in any way by specific choice of lipase enzyme.

Additional Enzymes

Additional enzymes suitable for use in the present compositions include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Peroxidases suitable for compositions are disclosed in WO 89099813 A and WO 8909813 A to Novo.

Peroxidase enzymes can be used in combination with oxygen sources, e.g., percarbonate, perborate, hydrogen peroxide, and the like. Additional enzymes suitable for incorporation into the present composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the composition of the present invention can be derived from a plant, an animal, or a microorganism. Preferably the enzyme is derived from a microorganism. The enzyme can be purified or a component of an extract, and either wild type or variant (either chemical or recombinant). In preferred embodiments of this invention, the amount of commercial additional enzyme, such as a cutinase or peroxidase, present in the composition of the invention ranges from about 0.1% by weight of detersive solution to about 3% by weight, preferably about 1% to about 3% by weight, of solution of the commercial enzyme product. Typical commercially available detersive enzymes include about 5-10 percent of active enzyme.

Whereas establishing the percentage by weight of additional enzyme, such as a cutinase or peroxidase, required is of practical convenience for manufacturing embodiments of the present teaching, variance in commercial additional enzyme concentrates and in-situ environmental additive and negative effects upon their activity may require a more discerning analytical technique for the enzyme assay to quantify enzyme activity and establish correlations to soil residue removal performance and to enzyme stability within the embodiment; and, if a concentrate, to use-dilution solutions. The activity of the additional enzyme, such as a cutinase or peroxidase, for use in the present invention can be expressed in known units or through known or commercially available assays.

Naturally, mixtures of different additional enzymes can be incorporated into this invention. While various specific enzymes have been described above, it is to be understood that any additional enzyme which can confer the desired enzyme activity to the composition can be used and this embodiment of this invention is not limited in any way by specific choice of enzyme.

Enzyme Stabilizing System

The present compositions can also include ingredients to stabilize one or more enzymes. For example, the cleaning composition of the invention can include a water-soluble source of calcium and/or magnesium ions. Calcium ions are generally more effective than magnesium ions and are preferred herein if only one type of cation is being used. Compositions, especially liquids, can include from about 1 to about 30, preferably from about 2 to about 20, more preferably from about 8 to about 12 millimoles of calcium ion per liter of finished composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing compositions, may further include from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired.

In general, since the chlorine scavenger function can be performed by ingredients separately listed under better recognized functions, there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is unacceptably incompatible, as formulated, with other reactive ingredients. In relation to the use of ammonium salts, such salts can be simply admixed with the composition but are prone to adsorb water and/or liberate ammonia during storage. Accordingly, such materials, if present, are desirably protected in a particle such as that described in U.S. Pat. No. 4,652,392, Baginski et al.

Antimicrobial Agent

In certain embodiments, the present composition can include antimicrobial agent. For example, a composition including an enzyme can include any of a variety of antimicrobial agents compatible with the enzyme and enzyme activity. For example, a composition including a spore can include any of a variety of antimicrobial agents compatible with the spore. The antimicrobial agent can be selected to persist for a shorter time than the spore. After the antimicrobial agent is sufficiently gone, the spore can germinate to form microbes without the microbe being killed or inhibited by the antimicrobial agent. For example, a composition including a microbe can include an antimicrobial agent ineffective against that microbe.

Any of a variety of suitable antimicrobial agents can be employed at effective antimicrobial concentration. Antimicrobial agents include active oxygen compounds (e.g., hydrogen peroxide, percarbonate, perborate, and the like), halogen containing compounds, amine or quaternary ammonium compounds, or the like. Suitable antimicrobial agents include amine and quaternary ammonium antimicrobial agents, such as aliphatic amine, ether amine, diamine, or a salt thereof. A salt of an aliphatic amine is an aliphatic ammonium salt. A salt of a ether amine is an ether ammonium salt. A salt of a diamine is a diamine salt, e.g., diamine acetate.

In an embodiment, the present composition can include an effective amount (e.g., antimicrobial amount) of ether amine of Formula 1:

$$R_1—O—R_2—NH_2;$$

of Formula 2:

$$R_1—O—R_2—NH—R_3—NH_2;$$

mixtures thereof, or salts thereof. In Formula 1 and Formula 2 (independently) $R_1$ can be a linear saturated or unsaturated $C_6$-$C_{18}$ alkyl, $R_2$ can be a linear or branched $C_1$-$C_8$ alkyl, and $R_3$ can be a linear or branched $C_1$-$C_8$ alkyl. In an embodiment, $R_1$ is a linear $C_{12}$-$C_{16}$ alkyl; $R_2$ is a $C_2$-$C_6$ linear or branched alkyl; and $R_3$ is a $C_2$-$C_6$ linear or branched alkyl. In an embodiment, the present composition includes a linear alkyl ether diamine compound of Formula 2 in which $R_1$ is $C_{12}$-$C_{16}$, $R_2$ is $C_3$, and $R_3$ is $C_3$. In an embodiment, R1 is either a linear alkyl $C_{12}$-$C_{16}$ or a mixture of linear alkyl $C_{10}$-$C_{12}$ and $C_{14}$-$C_{16}$. Suitable ether amines are commercially available from Tomah Products Incorporated as PA-19, PA-1618, PA-1816, DA-18, DA-19, DA-1618, DA-1816, and the like.

In an embodiment, the antimicrobial agent can include or be a diamine, such as a diamine acetate. Suitable diamines, shown as the acetates, include those having the formulas:

$$[(R^1)NH(R^2)NH_3]^+(CH_3COO)^-$$

or $$[(R^1)NH_2(R^2)NH_3^{++}](CH_3COO)_2^-$$

in which $R^1$ can be C10-C18 aliphatic group or an ether group having the formula $R^{10}OR^{11}$ in which $R^{10}$ is a C10-C18 aliphatic group and $R^{11}$ is a C1-C5 alkyl group; and $R^2$ is a C1-C5 alkylene group. Suitable diamine acetates include those in which $R^1$ is a C10-C18 aliphatic group derived from a fatty acid and $R^2$ is propylene. The diamine can have a counter ion other than acetate.

Representative examples of useful diamines include N-coco-1,3-propylene diamine, N-oleyl-1,3-propylene diamine, N-tallow-1,3-propylene diamine, mixtures thereof, or salts thereof. Such N-alkyl-1,3-propylene diamines are available from Akzo Chemie America, Armak Chemicals under the trademark Duomeen.

The amount of the amine compound in the composition can be about 0.1 wt-% to 90 wt-%, about 0.25 wt-% to 75 wt-%, or about 0.5 wt-% to 50 wt-%. The amount of the amine compound in use compositions can be about 10 ppm to 10000 ppm, about 20 ppm to 7500 ppm, and about 40 ppm to 5000 ppm.

In an embodiment, the present composition can provide greater than 3 $\log_{10}$ reduction of bacteria within a 5 minute contact time. In an embodiment, the present composition can provide in excess of 5 $\log_{10}$ reduction of microorganisms. This can be advantageous in food preparation and food processing and other areas where triglyceride fats and lipids are soil components.

Cleaning Compositions Including the Stabilized Microbial or Enzyme Preparation

The present invention also relates to cleaning compositions including the present stabilized microbial and/or enzyme preparation. In an embodiment, the concentrate and the dilute aqueous cleaning compositions of this invention can include an effective concentration of a blended surfactant including a nonionic surfactant and a silicone surfactant, plus the present stabilized microbial and/or enzyme preparation. These compositions can also include anionic surfactant and a hydrotrope or solubilizer, which can maintain a single phase non-separating aqueous solution or suspension. Suitable cleaning compositions into which the present stabilized microbial and/or enzyme preparation can be included are described in U.S. Pat. Nos. 6,425,959 and 6,506,261, the disclosures of which are incorporated herein by reference.

In an embodiment, the compositions and methods can include a nonionic surfactant and a nonionic silicone surfactant. This composition can also include an anionic surfactant and a hydrotrope (that can be an anionic compound with little surfactant character), e.g., an amine oxide material. Such a composition can be used neat, without diluent, to remove complex oily or greasy organic soils and inorganic soils from typically hard metallic or other hard surfaces. The compositions can contain a source of alkalinity and a sufficient blend to obtain excellent cleaning properties.

In an embodiment, the cleaning compositions (concentrates or dilutable liquids) of the invention can include about 0.003 to about 70% by weight of a blended surfactant composition containing a nonionic surfactant and a nonionic silicone surfactant. The nonionic surfactant can be free of a silicone moiety, can be a block (EO)(PO) copolymer, an alcohol alkoxylate, an alkyl phenol alkoxylate, or an amine alkoxylate, wherein alkoxylate is an (EO) or (PO) moiety). The weight ratio of the nonionic surfactant to the nonionic silicone surfactant can be about 1 to about 10 parts by weight, preferably 3 to 7 parts of the nonionic surfactant or blend thereof per each one part by weight of the silicone surfactant or blend thereof. Such a composition can also include about 0.003 to about 35 wt-% of one or more anionic surfactants; about 0.001 to about 20% by weight of one or more effective hydrotropes; or mixtures thereof. The hydrotrope can be an alkyl di-methyl amine oxide. The hydrotrope can maintain the chelating agent and the surfactant blend in a uniform single phase aqueous composition.

In an embodiment, the concentrate compositions of the invention can include about 1 to about 15 wt-% of one or more nonionic silicone surfactants, about 5 to about 75 wt-% of one or more nonionic surfactants, about 5 to 75 wt-% of one or more anionic surfactants, and about 2 to 20 wt-% of one or more hydrotrope solubilizers (e.g., an amine oxide material). In this embodiment, the ratio between the nonionic surfactant and the nonionic silicone surfactant can be about 3 to about 7 parts by weight of a nonionic surfactant per each part by weight of the nonionic silicone surfactant.

In embodiment of a dilute aqueous formulated composition, the aqueous solution can include about 0.0005 to about 35 wt-% or about 0.1 to about 10 wt-% of the silicone surfactant, about 0.0003 to 35 wt-% or about 0.3 to 30 wt-% of the nonionic surfactant, about 0.003 to 35 wt-% or about 0.3 to 30 wt-% of the anionic surfactant, and about 0.001 to 20 wt-% or 0.2 to about 30 wt-% of the hydrotrope solubilizer while maintaining the ratio of nonionic to silicone surfactant as set forth above.

In an embodiment, the cleaner concentrate can include in an aqueous base: about 0.003 to 35 wt-% or about 0.1 to 25 wt-% of a chelating agent or sequestering agent; about 0.003 to 35 wt-% or about 0.3 to 30 wt-% of a nonionic surfactant; about 0.0005 to 35 wt-% or about 0.01 to 10 wt-% of a nonionic silicone surfactant; about 0.003 to 30 wt-% of an anionic surfactant; and about 0.001 to 20 wt-% or about 0.2 to 30 wt-% of a hydrotrope or surfactant solubilizer (e.g., an amine oxide).

The cleaner concentrate can be used neat or can be diluted with service water at a sufficient proportion to obtain the dilute active aqueous cleaner set forth above. In the context of the invention, the term "neat" indicates the substantial absence of a diluent such as an aqueous medium. The resulting dilute cleaner can be applied to the soiled substrate for soil removal.

For the purpose of this patent application, the cleaning compositions can include a chelating agent, a nonionic/nonionic silicone surfactant blend, an anionic surfactant, and a hydrotrope (e.g., an amine oxide). Such embodiments can be useful for soil removal from a corrosion resistant surface. The chelating agent can be a potassium salt. Similarly, the hydrotrope can be a potassium salt.

Embodiments of Cleaning Compositions

In certain embodiments, the cleaning compositions of the present invention can be described by the ingredients and amounts listed in the tables below. The ingredients of the stabilized microbial composition are not listed in the tables below, but are present as described above. The amounts or ranges in these tables can also be modified by about.

Concentrate Composition

| Chemical | wt-% | wt-% | wt-% |
|---|---|---|---|
| Chelating Agent | 0 to 30 | 0 to 15 | 0 to 15 |
| Silicone Surfactant | 0.1 to 35 | 0.1 to 10 | 0, 1 to 7, or 0-5 |
| Nonionic Surfactant | 0.5 to 35 | 1 to 20 | 1 to 15 |
| Anionic Surfactant | 0 to 35 | 0 to 20 | 0 to 15 |
| Hydrotrope | 0.1 to 20 | 0.5 to 15 | 0.5 to 5 |
| Antimicrobial Agent | 1-9 | 1-5 | 2-3 |

| Chemical | wt-% | wt-% |
|---|---|---|
| Chelating Agent | 0 to 30 | 0 to 15 |
| Surfactant blend | 0.5 to 70 | 1 to 30 |
| Amine Oxide Hydrotrope | 0.1 to 20 | 0.5 to 15 |
| Optional Acid | to ≧ pH 9 | to ≧ pH 10 |
| Antimicrobial Agent | 1-9 | 2-3 |

| Chemical | wt-% | wt-% | wt-% | wt-% | wt-% |
|---|---|---|---|---|---|
| Nonionic Surfactant | 2-16 | 4-16 | 2-8 | 8 | 4 |
| Silicone Surfactant | 0.5-6 | 1-6 | 0.5-2 | 3 | 0 or 1 |
| Amphoteric Surfactant | 1-10 | 2-10 | 1-6 | 5 | 3 |
| Hydrotrope | 1-20 | 5-20 | 1-6 | 11 | 3-4 |
| Antimicrobial Agent | 1-9 | 1-5 | 1-5 | 2-3 | 2-3 |

Dilute Aqueous Composition (as is or as formulation additive)

| Chemical | ppm | ppm | ppm |
|---|---|---|---|
| Chelating Agent | 0 to 150,000 | 0 to 20,000 | 0 to 10,000 |
| Surfactant Blend | 30 to 175,000 | 3000 to 100,000 | 6000 to 50,000 |
| Hydrotrope | 10 to 100,000 | 1000 to 60,000 | 2000 to 20,000 |
| Aqueous diluent and stabilized microbial and/or enzyme composition | Balance | Balance | Balance |

| Chemical | ppm | ppm |
|---|---|---|
| Chelating Agent | 6 to 70,000 | 600 to 20,000 |
| Surfactant Blend | 30 to 350,000 | 3000 to 100,000 |
| Anionic Surfactant | 30 to 350,000 | 3000 to 100,000 |
| Amine Oxide Hydrotrope | 7 to 80,000 | 700 to 25,000 |
| Optional Acid | to ≧ pH 9 | to ≧ pH 10 |
| Aqueous diluent and stabilized microbial and/or enzyme composition | Balance | Balance |

Compositions with formulas listed in the table below have been found to be advantageous with respect to one or more of physical stability, enzyme stability, and antimicrobial efficacy (e.g., sanitizing efficacy).

Composition

| Ingredient | Concentrate (wt-%) | Use Composition (ppm) |
|---|---|---|
| Water | 40-90% | |
| Antimicrobial | 1-9% | 40-2100 |
| Glacial Acetic Acid | 0-3% | 0-700 |
| Propylene Glycol | 5-12% | 200-3000 |
| Boric Acid | 2-5% | 80-1200 |
| monoethanolamine | 2-8% | 80-1900 |
| ethylenediaminetetraacetic acid | 0.1-5% | 4-1200 |
| first polyether siloxane | 0-5% | 0-1200 |
| second polyether siloxane | 0-5% | 0-1200 |
| lauryl dimethyl amine oxide | 0-5% | 0-1200 |
| cocoamphodipropionate | 0-5% | 0-1200 |
| secondary alcohol 7 mole ethoxylate | 0-5% | 0-1200 |
| lipase | 0.5-3% | 20-700 |
| pH | 6.5-9.5 | |

**Use solution ranges from 0.5-3 oz/gal.

The tables above show useful compositions for the cleaning compositions of the present invention. The tables list the amounts of certain ingredients and the present stable microbial and/or enzyme compositions also include spore, bacteria, fungi, or enzyme and boric acid salt. Such compositions can be used as organic soil or grease removers. The surfactant blends set forth above refer to the combination of a nonionic and a silicone nonionic surfactant at the ratios disclosed above. Further, chelating agents are useful but not necessary. Chelating agents provide chelation and soil removal, but can contribute to corrosion or other chemical harm to certain surfaces.

In an embodiment, the present cleaning composition includes spore, bacteria, fungi, or enzyme; and borate salt, e.g., alkanol amine borate. In certain embodiments, the composition can also include about 0.003 to about 35 wt-% nonionic surfactant, for example, about 0.5 to about 35 wt-% nonionic surfactant. The nonionic surfactant can include nonionic block copolymer comprising of at least $(EO)_y(PO)_z$, wherein y and z are independently between 2 and 100; $C_{6-24}$ alkyl phenol alkoxylate having 2 to 15 moles of ethylene oxide; $C_{6-24}$ alcohol alkoxylate having 2 to 15 moles of ethylene oxide; alkoxylated amine having 2-20 moles of ethylene oxide; or mixtures thereof.

In certain embodiments, the composition can also include about 0.0005 to about 35 wt-% silicone surfactant, for example, about 0.1 to about 35 wt-% silicone surfactant. The silicone surfactant can include a silicone backbone and at least 1 pendant alkylene oxide group having from about 2 to 100 moles of alkylene oxide. The pendant alkylene oxide group can include $(EO)_n$ wherein n is 3 to 75.

In certain embodiments, the composition can also include about 0.003 to about 35 wt-% anionic surfactant, for example, about 0.5 to about 35 wt-% anionic surfactant. The anionic surfactant can include linear alkyl benzene sulfonate; alpha olefin sulfonate; alkyl sulfate; secondary alkane sulfonate; sulfosuccinate; or mixtures thereof. The anionic surfactant can include alkanol ammonium alkyl benzene sulfonate. The anionic surfactant can include monoethanol ammonium alkyl benzene sulfonate.

In certain embodiments, the composition can also include about 0.001 to about 20 wt-% hydrotrope, for example about 0.1 to about 20 wt-% hydrotrope. The hydrotrope can include $C_{6-24}$ alkyldimethyl amine oxide; alkylated diphenyl oxide disulfonate; or mixtures thereof. The hydrotrope can include isoalkyldimethyl amine oxide surfactant. The hydrotrope can include iso-$C_{10-14}$ alkyldimethylamine oxide. The hydrotrope can include alkylated diphenyl oxide disulfonic acid or salts thereof.

In an embodiment, the composition can also include about 0.5 to about 35 wt-% nonionic surfactant and about 0.1 to about 35 wt-% silicone surfactant. In this embodiment, the nonionic surfactant can include nonionic block copolymer comprising of at least $(EO)_y(PO)_z$; $C_{6-24}$ alkyl phenol alkoxylate having 2 to 15 moles of ethylene oxide; $C_{6-24}$ alcohol alkoxylate having 2 to 15 moles of ethylene oxide; alkoxylated amine having 2-20 moles of ethylene oxide; or mixtures thereof. In this embodiment, the silicone surfactant can include a silicone backbone and at least 1 pendant alkylene oxide group having from about 2 to 100 moles of alkylene oxide.

In this embodiment, the weight ratio of the nonionic surfactant to the nonionic silicone surfactant can be about 0.1 to about 10 parts by weight of the nonionic surfactant per each part of the silicone surfactant. In an embodiment the weight ratio of the nonionic surfactant to the nonionic silicone surfactant can be about 3 to about 7 parts by weight of the nonionic surfactant per each part of the silicone surfactant.

In certain embodiments, the composition can also include about 0.5 to about 35 wt-% nonionic surfactant, about 0.1 to about 35 wt-% silicone surfactant, about 0.5 to about 35 wt-% anionic surfactant, and about 0.1 to about 20 wt-% hydrotrope.

Ingredients for Stabilized Microbial or Enzyme Preparations

The present stabilized microbial or enzyme preparations and/or cleaning compositions can include any of a variety of ingredients that can be useful for cleaning or other uses. Such ingredients can include surfactant, hydrotrope, chelating agents, divalent cation, polyol, aesthetic enhancing agent, solvent, preservative, or the like.

In certain embodiments, the composition can also include an effective amount of one or more solvents; an effective amount of one or more enzymes; an effective amount of one or more antimicrobials; an effective amount of one or more chelating agents; or mixtures thereof. The composition can include about 0.1 to 30 wt-% of chelating agent. The chelating agent can include small or polymeric compound having carboxyl group, or mixtures thereof.

The enzyme can include detersive enzyme. The detersive enzyme can include protease, amylase, lipase, cellulase, peroxidase, gluconase, or mixtures thereof. The detersive enzyme can include alkaline protease, lipase, amylase, or mixtures thereof.

In certain embodiments, the composition can also include source of calcium ions, polyol, builder, dye, or a combination or mixture thereof.

Surfactant

The surfactant or surfactant admixture of the present invention can be selected from water soluble or water dispersible nonionic, semi-polar nonionic, anionic, cationic, amphoteric, or zwitterionic surface-active agents; or any combination thereof. The particular surfactant or surfactant mixture chosen for use in the process and products of this invention can depend on the conditions of final utility, including method of manufacture, physical product form, use pH, use temperature, foam control, and soil type. Surfactants incorporated into the cleaning compositions of the present invention are preferably enzyme compatible, not substrates for enzymes in the composition, and not inhibitors or inactivators of the enzyme. For example, when proteases and amylases are employed in the present compositions, the surfactant is preferably free of peptide and glycosidic bonds. In addition, certain cationic surfactants are known to decrease enzyme effectiveness.

Generally, the concentration of surfactant or surfactant mixture useful in stabilized compositions of the present invention fall in the range of from about 0.5% to about 40% by weight of the composition, preferably about 2% to about 10%, preferably about 5% to about 8%. These percentages can refer to percentages of the commercially available surfactant composition, which can contain solvents, dyes, odorants, and the like in addition to the actual surfactant. In this case, the percentage of the actual surfactant chemical can be less than the percentages listed. These percentages can refer to the percentage of the actual surfactant chemical.

Nonionic Surfactant

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

EOPO Nonionic Surfactant

An example of useful nonionic surfactants used with the silicone surfactants are polyether compounds prepared from ethylene oxide, propylene oxide, in a graft moiety homopolymer or a block or heteric copolymer. Such polyether compounds are known as polyalkylene oxide polymers, polyoxyalkylene polymers, or polyalkylene glycol polymers. Such nonionic surfactants have a molecular weight in the range of about 500 to about 15,000. Certain types of polyoxypropylene-polyoxyethylene glycol polymer nonionic surfactants have been found to be particularly useful. Surfactants including at least one block of a polyoxypropylene and having at least one other block of polyoxyethylene attached to the polyoxypropylene block can be used. Additional blocks of polyoxyethylene or polyoxypropylene can be present in a molecule. These materials having an average molecular weight in the range of about 500 to about 15,000 are commonly available as PLURONIC® manufactured by the BASF Corporation and available under a variety of other trademarks of their chemical suppliers. In addition PLURONIC® R (reverse PLURONIC structure) are also useful in the compositions of the invention. Additionally, alkylene oxide groups used with an alcohol and an alkyl phenol, a fatty acid or other such group can be useful. A useful surfactant can include a capped polyalkoxylated $C_{6-24}$ linear alcohol. The surfactants can be made with polyoxyethylene or polyoxypropylene units and can be capped with common agents forming an ether end group. A useful species of this surfactant is a $(PO)_x$ compound or benzyl ether compound polyethoxylated $C_{12-14}$ linear alcohol; see U.S. Pat. No. 3,444,247. Particularly useful polyoxypropylene polyoxyethylene block polymers are those including a center block of polyoxypropylene units and blocks of polyoxyethylene units to each side of the center block.

These copolymers have the formula shown below:

$$(EO)_n\text{-}(PO)_m\text{-}(EO)_n$$

wherein m is an integer of 21 to 54; n is an integer of 7 to 128. Additional useful block copolymers are block polymers having a center block of polyoxyethylene units and blocks of polyoxypropylene units to each side of the center block. The copolymers have the formula as shown below:

$$(PO)_n\text{-}(EO)_m\text{-}(PO)_n$$

wherein m is an integer of 14 to 164 and n is an integer of 9 to 22.

One suitable nonionic surfactant for use in the compositions of the invention include an alkyl phenol alkoxylate of the formula:

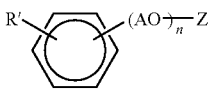

wherein R' includes a $C_{2-24}$ aliphatic group and AO represents an ethylene oxide group, a propylene oxide group, an heteric mixed EOPO group or a block EO-PO, PO-EO, EOPOEO or POEOPO group, and Z represents H or an (AO), Benzyl or other cap. A suitable nonionic surfactant includes an alkyl phenol ethoxylate of the formula:

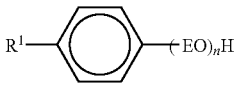

wherein $R^1$ includes a $C_{6-18}$ aliphatic group, preferably a $C_{6-12}$ aliphatic group and n is an integer of about 2 to about 24. A primary example of such a surfactant is a nonyl phenol ethoxylate having 2.5 to 14.5 moles of EO in the ethoxylate group. The ethoxylate group can be capped with a $(PO)_x$ group when x is 2.5 to 12.5 or a benzyl moiety.

Alkoxylated Amines

The present compositions can include any of a variety of alkoxylated amines. In an embodiment, the alkoxylated amine has general Formula I: $N(R_1)(R_2)(R_3)(R_4)$, in which at least one of $R_1$, $R_2$, or $R_3$ includes an alkoxylate or ether moiety. $R_4$ can be hydrogen, straight or branched alkyl, or straight or branched alkyl aryl. The alkoxylated amine can be a primary, secondary, or tertiary amine. In an embodiment, the alkoxylated amine is a tertiary amine. In certain embodiments, each of $R_2$ and $R_3$ includes an alkoxylate moiety, e.g., one or more ethoxylate moieties, one or more propoxylate moieties, or combinations thereof, and $R_4$ is hydrogen. For example, one of $R_1$, $R_2$, or $R_3$ can include an ether moiety and the other two can include one or more ethoxylate moieties, one or more propoxylate moieties, or combinations thereof.

By way of further example, an alkoxylated amine can be represented by general Formulae IIa, IIb, or IIc, respectively:

$$R^5\text{-}(PO)_sN\text{-}(EO)_tH, \qquad \text{IIa}$$

$$R^5\text{-}(PO)_sN\text{-}(EO)_tH(EO)_uH, \text{ and} \qquad \text{IIb}$$

$$R^5\text{—}N(EO)_tH;\text{tm IIc}$$

in which $R^5$ can be an alkyl, alkenyl or other aliphatic group, or an alkyl-aryl group of from 8 to 20 or from 12 to 14 carbon atoms, EO is oxyethylene, PO is oxypropylene, s is 1-20, 2-12, or 2 to 5, t is 1-20, 1-10, 2-12, or 2-5, and u is 1-20, 1-10, 2-12, or 2-5. Other variations on the scope of these compounds can be represented by formula IId:

$$R^5\text{-}(PO)_v\text{-}N[(EO)_wH][(EO)_nH]$$

in which $R^5$ is as defined above, v is 1 to 20 (e.g., 1, 2, 3, or 4 or, in an embodiment, 2), and w and z are independently 1-20, 1-10, 2-12, or 2-5.

In an embodiment, the alkoxylated amine is an ether amine alkoxylate. An ether amine alkoxylate can have Formula III:

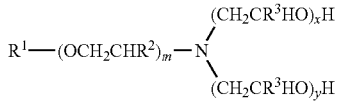

In Formula III, $R^1$ can be a straight or branched alkyl or alkylaryl; $R^2$ can independently in each occurrence be hydrogen or alkyl from 1 to 6 carbons; $R^3$ can independently in each occurrence be hydrogen or alkyl of from 1 to 6 carbons; m can average from about 1 to about 20; x and y can each independently average from 1 to about 20; and x+y can average from about 2 to about 40.

In an embodiment, in Formula III, $R^1$ can be: alkyl of from 8 to 24 carbon atoms, alkylaryl and contain from about 7 to about 30 carbon atoms, or alkylaryl (e.g., alkylaryl disubstituted with alkyl groups); $R^2$ can contain 1 or 2 carbon atoms or can be hydrogen; $R^3$ can be hydrogen, alkyl containing 1 or 2 carbons; and x+y can range from about 1 to about 3.

Such ether amine alkoxylates are described in U.S. Pat. Nos. 6,060,625 and 6,063,145.

In an embodiment, in Formula III, $R^1$ can be: alkyl of from 6 to 24 carbon atoms, alkylaryl and contain from about 7 to about 30 carbon atoms, or alkylaryl (e.g., alkylaryl disubstituted with alkyl groups); $R^2$ can contain 1 or 2 carbon atoms or can be hydrogen; $R^3$ can be hydrogen, alkyl containing 1 or 2 carbons; and x+y can range from about 1 to about 20.

In an embodiment, in Formula III, m can be 0 to about 20 and x and y can each independently average from 0 to about 20. In certain embodiments, the alkoxy moieties can be capped or terminated with ethylene oxide, propylene oxide, or butylene oxide units.

In an embodiment, in Formula III, $R^1$ can be $C_6$-$C_{20}$ alkyl or $C_9$-$C_{13}$ alkyl, e.g., linear alkyl; $R^2$ can be $CH_3$; m can be about 1 to about 10; $R^3$ can be hydrogen; and x+y can range from about 5 to about 12.

In an embodiment, in Formula III, $R^1$ can be $C_6$-$C_{14}$ alkyl or $C_7$-$C_{14}$ alkyl, e.g., linear alkyl; $R^2$ can be $CH_3$; m can be about 1 to about 10; $R^3$ can be hydrogen; and x+y can range from about 2 to about 12. In an embodiment, such an ether amine alkoxylate can include alkoxylate moieties terminated with propylene oxide or butylene oxide units, which can provide low foam compositions.

In an embodiment, in Formula III, $R^1$ can be $C_6$-$C_{14}$ alkyl, e.g., linear alkyl; $R^2$ can be $CH_3$; m can be about 1 to about 10; $R^3$ can be hydrogen; and x+y can range from about 2 to about 20.

In an embodiment, the alkoxylated amine can be a $C_{12}$ to $C_{14}$ propoxy amine ethoxylate in which, in Formula III, $R^1$ can be $C_{12}$-$C_{14}$ alkyl, e.g., linear alkyl; $R^2$ can be $CH_3$; m can be about 10; $R^3$ can be hydrogen; x can be about 2.5, and y can be about 2.5.

In an embodiment, the alkoxylated amine can be a $C_{12}$ to $C_{14}$ propoxy amine ethoxylate in which, in Formula III, $R^1$ can be $C_{12}$-$C_{14}$ alkyl, e.g., linear alkyl; $R^2$ can be $CH_3$; m can be about 5; $R^3$ can be hydrogen; x can be about 2.5, and y can be about 2.5.

In an embodiment, the alkoxylated amine can be a $C_{12}$ to $C_{14}$ propoxy amine ethoxylate in which, in Formula III, $R^1$ can be $C_{12}$-$C_{14}$ alkyl, e.g., linear alkyl; $R^2$ can be $CH_3$; m can be about 2; $R^3$ can be hydrogen; x can be about 2.5, and y can be about 2.5.

In an embodiment, in Formula III, $R^1$ can be branched $C_{10}$ alkyl; $R^2$ can be $CH_2$; m can be 1; $R^3$ can be hydrogen; and x+y can be about 5. Such an alkoxylated amine can be a tertiary ethoxylated amine known as poly (5) oxyethylene isodecyloxypropylamine.

In an embodiment, the alkoxylated amine can be a secondary ethoxylated amine that can be described by the formula: R-(PO)-N-$(EO)_x$ where x=1 to 7 moles of ethylene oxide.

In an embodiment the alkoxylated amine can be a diamine that can be described by the formula R—O—CH2CH2CH2N(H)(CH2CH2CH2NH2) in which R is, for example, branched $C_{10}$ alkyl.

In an embodiment, the ether amine alkoxylate of Formula III is an ether amine ethoxylate propoxylate of Formula IV:

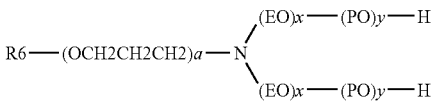

In Formula IV, $R^6$ can be a straight or branched alkyl or alkylaryl; a can average from about 1 to about 20; x and y can each independently average from 0 to about 10; and x+y can average from about 1 to about 20. Such an ether amine alkoxylate can be referred to as an ether amine ethoxylate propoxylate. In certain embodiments, the alkoxy moieties can be capped or terminated with ethylene oxide, propylene oxide, or butylene oxide units.

In an embodiment, the alkoxylated amine can be a $C_{12}$ to $C_{14}$ propoxy amine ethoxylate that can be described by the formula: R—$(PO)_2N[EO]_{2.5}$-H[EO]2.5-H. In an embodiment, the alkoxylated amine can be a $C_{12}$ to $C_{14}$ propoxy amine ethoxylate that can be described by the formula: R-$(PO)_{10}$N[EO]2.5-H$[EO]_{2.5}$-H. In an embodiment, the alkoxylated amine can be a $C_{12}$ to $C_{14}$ propoxy amine ethoxylate that can be described by the formula: R-$(PO)_5N[EO]_{2.5}$-H$[EO]_{2.5}$-H. In an embodiment, the alkoxylated amine can be a tertiary ethoxylated amine known as poly (5) oxyethylene isodecyloxypropylamine, which has a branched $C_{10}H_{21}$ alkyl group off the ether oxygen. In an embodiment, the alkoxylated amine can be a diamine that can be described by the formula R—O—CH2CH2CH2N(H)(CH2CH2CH2NH2) in which R is branched $C_{10}$ alkyl. In an embodiment, the alkoxylated amine can be a tertiary ethoxylated amine known as iso-(2-hydroxyethyl) isodecyloxypropylamine, which has a branched $C_{10}H_{21}$ alkyl group off the ether oxygen.

Ether amine alkoxylates are commercially available, for example, under tradenames such as Surfonic (Huntsman Chemical) or Tomah Ether or Ethoxylated Amines.

In an embodiment, the alkoxylated amine is an alkyl amine alkoxylate. A suitable alkyl amine alkoxylate can have Formula V:

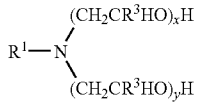

In Formula V, $R^1$ can be a straight or branched alkyl or alkylaryl; $R^3$ can independently in each occurrence be hydrogen or alkyl of from 1 to 6 carbons; x and y can each independently average from 0 to about 25; and x+y can average from about 1 to about 50. In an embodiment, in Formula V, x and y can each independently average from 0 to about 10; and x+y can average from about 1 to about 20. In an embodiment, the alkoxy moieties can be capped or terminated with ethylene oxide, propylene oxide, or butylene oxide units.

In an embodiment, the alkyl amine alkoxylate of Formula V is an alkyl amine ethoxylate propoxylate of Formula VI:

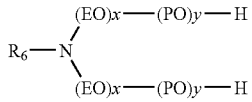

In Formula VI, $R^6$ can be a straight or branched alkyl or alkylaryl (e.g., C18 alkyl); x and y can each independently average from 0 to about 25; and x+y can average from about 1 to about 50. In an embodiment, in Formula VI, x and y can each independently average from 0 to about 10 or 20; and x+y can average from about 1 to about 20 or 40. Such an ether amine alkoxylate can be referred to as an amine ethoxylate propoxylate.

One such alkyl amine ethoxylate propoxylate can be described by the chemical names N,N-bis-2(omega-hydroxypolyoxyethylene/polyoxypropylene)ethyl alkylamine or N,N-Bis(polyoxyethylene/propylene) tallowalkylamine, by CAS number 68213-26-3, and/or by chemical formula $C_{64}H_{130}O_{18}$.

Alkyl amine alkoxylates are commercially available, for example, under tradenames such as Armoblen (Akzo Nobel). Armoblen 600 is called an alkylamine ethoxylate propoxylate.

In an embodiment, the alkoxylated amine is an ether amine. Suitable ether amines can have general Formula VII: $N(R_1)(R_2)(R_3)$, in which at least one of $R_1$, $R_2$, or $R_3$ includes an ether moiety. In an embodiment, $R_1$ includes an ether moiety and $R_2$, and $R_3$ are hydrogen. Such an ether amine can have Formula VIII:

$$R_4O(R_5)NH_2$$

In Formula VIII, $R_4$ can be $C_1$ to $C_{13}$ arylalkyl or alkyl, straight or branched chain and $R_5$ can be $C_1$ to $C_6$ alkyl, straight or branched chain.

Ether amines are commercially available, for example, from Tomah[3] Products.

Suitable alkoxylated amines can include amines known as ethoxylated amine, propoxylated amine, ethoxylated propoxylated amine, alkoxylated alkyl amine, ethoxylated alkyl amine, propoxylated alkyl amine, ethoxylated propoxylated alkyl amine, ethoxylated propoxylated quaternary ammonium compound, ether amine (primary, secondary, or tertiary), ether amine alkoxylate, ether amine ethoxylate, ether amine propoxylate, alkoxylated ether amine, alkyl ether amine alkoxylate, alkyl propoxyamine alkoxylate, alkylalkoxy ether amine alkoxylate, and the like.

Additional Nonionic Surfactants

Additional useful nonionic surfactants in the present invention include:

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include nonionic surfactants described above that are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Polyhydroxy fatty acid amide surfactants suitable for use in the present compositions include those having the structural formula $R^2CONR^1Z$ in which: R1 is H, $C_1$-$C_4$ hydrocarbyl, 2-hydroxy ethyl, 2-hydroxy propyl, ethoxy, propoxy group, or a mixture thereof, $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or —$(C_2H_4O)_xH$, where x is in the range of from 1 to 3.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

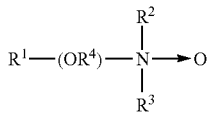

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

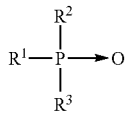

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

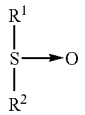

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like.

Silicone Surfactant

The silicone surfactant can include a modified dialkyl, e.g., a dimethyl polysiloxane. The polysiloxane hydrophobic group can be modified with one or more pendent hydrophilic polyalkylene oxide group or groups. Such surfactants can provide low surface tension, high wetting, high spreading, antifoaming and excellent stain removal. The silicone surfactants of the invention include a polydialkyl siloxane, e.g., a polydimethyl siloxane to which polyether, typically polyalkylene oxide, groups have been grafted through a hydrosilation reaction. The process results in an alkyl pendent (AP type) copolymer, in which the polyalkylene oxide groups are attached along the siloxane backbone through a series of hydrolytically stable Si—C bond.

These nonionic substituted poly dialkyl siloxane products have the following generic formula:

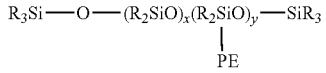

wherein PE represents a nonionic group, e.g., $—CH_2—(CH_2)_p—O-(EO)_m(PO)_n-Z$, with EO representing ethylene oxide, PO representing propylene oxide, x is a number that ranges from about 0 to about 100, y is a number that ranges from about 1 to 100, m, n and p are numbers that range from about 0 to about 50, m+n>1 and Z represents hydrogen or R wherein each R independently represents a lower ($C_{1-6}$) straight or branched alkyl. Such surfactants have a molecular weight ($M_n$) of about 500 to 20,000.

Other silicone nonionic surfactants have the formula:

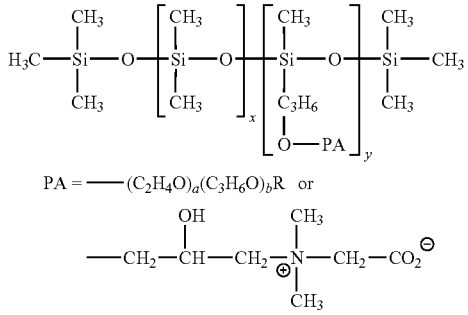

wherein x represent a number that ranges from about 0 to about 100, y represent a number that ranges from about 1 to about 100, a and b represent numbers that independently range from about 0 to about 60, a+b≧1, and each R is independently H or a lower straight or branched ($C_{1-6}$) alkyl. A second class of nonionic silicone surfactants is an alkoxy-end-blocked (AEB type) that are less preferred because the Si—O— bond offers limited resistance to hydrolysis under neutral or slightly alkaline conditions, but breaks down quickly in acidic environments.

Suitable surfactants are sold under the SILWET® tradename, the TEGOPREN® trademark or under the ABIL® B trademark. One useful surfactant, SILWET® L77, has the formula:

$$(CH_3)_3Si—O(CH_3)Si(R^1)O—Si(CH_3)_3$$

wherein $R^1=—CH_2CH_2CH_2—O—[CH_2CH_2O]_zCH_3$; wherein z is 4 to 16 preferably 4 to 12, most preferably 7-9.

Other useful surfactants include TEGOPRFN 5840®, ABIL B-8843®, ABIL B-8852® and ABIL B-8863®.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

Anionics are excellent detersive surfactants and are therefore, favored additions to heavy duty detergent compositions. Generally, however, anionics have high foam profiles which limit their use alone or at high concentration levels in cleaning systems such as CIP circuits that require strict foam control. Further, anionic surface active compounds can impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups, which are described in "Surfactant Encyclopedia", *Cosmetics & Toiletries*, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. Although each of these classes of anionic surfactants can be employed in the present compositions, it should be noted that certain of these anionic surfactants may be incompatible with the enzymes. For example, the acyl-amino acids and salts may be incompatible with proteolytic enzymes because of their peptide structure.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N-($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy)sulfates such as the sulfates or condensation products of ethylene oxide and nonyl phenol (usually having 1 to 6 oxyethylene groups per molecule. Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

In an embodiment, the present composition includes alkyl or alkyl aryl sulfonates or substituted sulfates and sulfated products. In certain embodiments, the present composition includes linear alkane sulfonate, linear alkylbenzene sulfonates, alphaolefin sulfonates, alkyl sulfates, secondary alkane sulfates or sulfonates, or sulfosuccinates.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

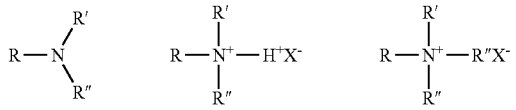

in which, R represents a long alkyl chain, R', R", and R"' may be either long alkyl chains or smaller alkyl or aryl groups or hydrogen and X represents an anion. The amine salts and quaternary ammonium compounds can be useful due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

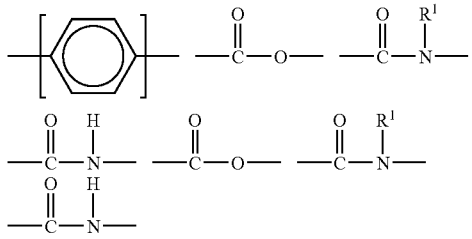

an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y is can be a group including, but not limited to:

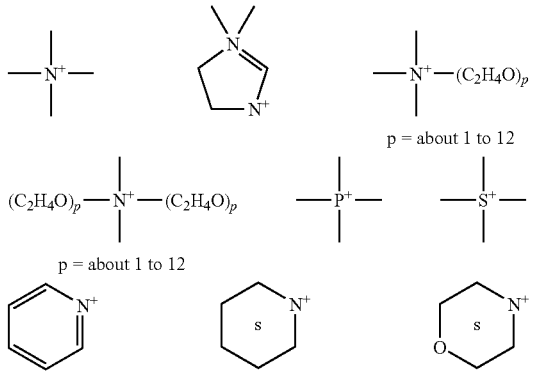

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge. Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

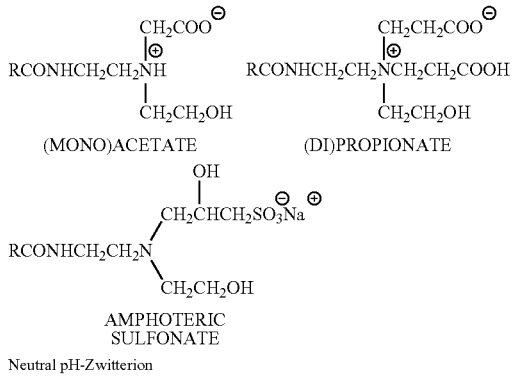

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which $R=C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these R is preferably an acyclic hydrophobic group containing from about 8 to about 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof, and an aliphatic substituent of from about 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

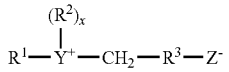

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S [N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

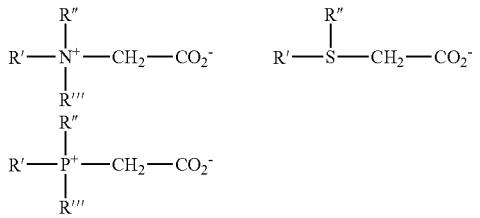

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Surfactant Compositions

The surfactants described hereinabove can be used singly or in combination in the practice and utility of the present invention. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants which can find application within the scope of this invention. The foregoing organic surfactant compounds can be formulated into any of the several commercially desirable composition forms of this invention having disclosed utility. Said compositions include washing treatments for soiled surfaces in concentrated form which, when dispensed or dissolved in water, properly diluted by a proportionating device, and delivered to the target surfaces as a solution, gel or foam will provide cleaning. Said cleaning treatments consisting of one product; or, involving a two product system wherein proportions of each are utilized. Said product is typically a concentrate of liquid or emulsion.

Hydrotrope

A hydrotropic agent is often employed in the formulation to maintain a single phase neat or aqueous composition. Such an agent may also be used in the present invention. Hydrotropy is a property that relates to the ability of materials to improve the solubility or miscibility of a substance in liquid phases in which the substance tends to be insoluble. Substances that provide hydrotropy are called hydrotropes and are used in relatively lower concentrations than the materials to be solubilized. A hydrotrope modifies a formulation to increase the solubility of an insoluble substance or creates micellar or mixed micellar structures resulting in a stable suspension of the insoluble substance. In this invention, the hydrotropes are most useful in maintaining the formulae components a uniform solution both during manufacture and when dispersed at the use location. The hydrotrope solubilizer can maintain a single phase solution having the components uniformly distributed throughout the composition in an aqueous or non-aqueous form.

Preferred hydrotrope solubilizers are used at about 0.1 to about 30 wt-% and include, for example, small molecule anionic surfactants and semi-polar nonionic surfactants. The most preferred range of hydrotrope solubilizers is about 1 to about 20 wt-%. Hydrotrope materials are relatively well known to exhibit hydrotropic properties in a broad spectrum of chemical molecule types. Hydrotropes generally include ether compounds, alcohol compounds, anionic surfactants, cationic surfactants and other materials. One important hydrotrope solubilizer for use in this invention includes an amine oxide material. The small molecule anionic surfactants include aromatic sulfonic acid or sulfonated hydrotropes such as $C_{1-5}$ substituted benzene sulfonic acid or naphthalene sulfonic acid. Examples of such a hydrotrope are xylene sulfonic acid or naphthalene sulfonic acid or salts thereof.

The semi-polar type of nonionic surface active agents include amine oxide hydrotropes such as tertiary amine oxides corresponding to the general formula:

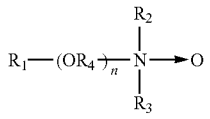

wherein n is 0 to 25 the arrow is a conventional representation of a semi-polar bond; and, $R_1$, $R_2$, and $R_3$ may be aliphatic, aromatic, heterocyclic, alicyclic, or combinations thereof. Generally, for amine oxides of detergent interest, $R_1$ is a branched or linear, aliphatic or alkyl radical of from about 8 to about 24 carbon atoms; $R_2$ and $R_3$ are selected from the group consisting of alkyl or hydroxyalkyl of 1-3 carbon atoms and mixtures thereof; $R_4$ is an alkylene or a hydroxyalkylene group containing 2 to 3 carbon atoms; and n ranges from 0 to about 20. Useful water soluble amine oxide hydrotropes are selected from alkyl di-(lower alkyl) amine oxides, specific examples of which are a $C_{10-14}$ iso-alkyl dimethyl amine oxide (iso-dodecyl) dimethyl amine oxide-Barlox 12i, n-decyldimethylamine oxide, dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide and 3,6,9-trioctadecyldimethylamine oxide. The most preferred of the above is isododecyldimethylamine oxide (Barlox 12i). Other hydrotropes or couplers may be generally used in compositions of the present invention to maintain physical single phase integrity and storage stability. To this end, any number of ingredients known to those skilled in formulation art may be employed, such as monofunctional and polyfunctional alcohols. These preferably contain from about 1 to about 6 carbon atoms and from 1 to about 6 hydroxy groups. Examples include ethanol, isopropanol, n-propanol, 1,2-propanediol, 1,2-butanediol, 2-methyl-2,4-pentanediol, mannitol and glucose. Also useful are the higher glycols, polyglycols, polyoxides, glycol ethers and propylene glycol ethers. Additional useful hydrotropes include the free acids and alkali metal salts of sulfonated alkylaryls such as alkylated diphenyloxide sulfonates, toluene, xylene, cumene and phenol or phenol ether sulfonates or alkoxylated diphenyl oxide disulfonates (Dowfax materials); alkyl and dialkyl naphthalene sulfonates and alkoxylated derivatives. These sulfonate materials used as hydrotropes are typically not considered to be strongly surfactant-like. These materials are sulfonates with an associated hydrophobic group that is designed to provide hydrotrope properties, not surfactant properties. With this in mind, these materials are typically considered to be not surfactant compositions.

Sequestrant

The present cleaning composition can include a sequestrant. In general, a sequestrant is a molecule capable of coordinating (i.e., binding) the metal ions commonly found in natural water to prevent the metal ions from interfering with the action of the other detersive ingredients of a cleaning composition. Some chelating/sequestering agents can also function as a threshold agent when included in an effective amount. For a further discussion of chelating agents/sequestrants, see Kirk-Othmer, *Encyclopedia of Chemical Technology*, Third Edition, volume 5, pages 339-366 and volume 23, pages 319-320.

A variety of sequestrants can be used in the present heterogeneous cleaning composition, including, for example, organic phosphonate, aminocarboxylic acid, condensed phosphate, inorganic builder, polymeric polycarboxylate, di- or tricarboxylic acid, mixture thereof, or the like. Such sequestrants and builders are commercially available. In certain embodiments, the present heterogeneous cleaning composition includes about 5 to about 50 wt-%, about 30 to about 50 wt-%, about 10 to about 45 wt-%, or about 20 to about 40 wt-% sequestrant. In certain embodiments, the present heterogeneous cleaning composition includes about 20 wt-%, about 25 wt-%, about 30 wt-%, about 35 wt-%, or about 40 wt-% sequestrant. The composition can include any of these ranges or amounts not modified by about.

Suitable condensed phosphates include sodium and potassium orthophosphate, sodium and potassium pyrophosphate, sodium and potassium tripolyphosphate, sodium hexametaphosphate, for example, tripolyphosphate. In an embodiment, the present heterogeneous cleaning composition includes as a builder, chelator, or sequestrant a condensed phosphate, such as sodium tripolyphosphate.

Polycarboxylates suitable for use as sequestrants include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, polymaleic acid, polyfumaric acid, copolymers of acrylic and itaconic acid, and the like. In an embodiment, the polycarboxylate includes polyacrylate.

Suitable di- or tricarboxylic acids include oxalic acid, citric acid, or salts thereof. In an embodiment, oxalic acid can be employed for reducing levels of iron in the use composition or removing iron soil from the article being cleaned. For example, oxalic acid can be part of an iron control sour or iron remover.

In an embodiment, the present heterogeneous cleaning composition includes as sequestrant or builder condensed phosphate and polyacrylate, or another polymer, for example, sodium tripolyphosphate and polyacrylate.

The builder can include an organic phosphonate, such as an organic-phosphonic acid and alkali metal salts thereof. Some examples of suitable organic phosphonates include:

1-hydroxyethane-1,1-diphosphonic acid: $CH_3C(OH)[PO(OH)_2]_2$;

aminotri(methylenephosphonic acid): $N[CH_2PO(OH)_2]_3$;

aminotri(methylenephosphonate), sodium salt

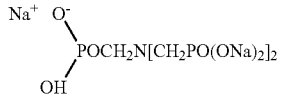

2-hydroxyethyliminobis(methylenephosphonic acid): $HOCH_2CH_2N[CH_2PO(OH)_2]_2$;

diethylenetriaminepenta(methylenephosphonic acid): $(HO)_2POCH_2N[CH_2CH_2N[CH_2PO(OH)_2]_2]_2$;

diethylenetriaminepenta(methylenephosphonate), sodium salt: $C_9H_{(28-x)}N_3Na_xO_{15}P_5$ (x=7);

hexamethylenediamine(tetramethylenephosphonate), potassium salt: $C_{10}H_{(28-x)}N_2K_xO_{12}P_4$ (x=6);

bis(hexamethylene)triamine(pentamethylenephosphonic acid): $(HO_2)POCH_2N[(CH_2)_6N[CH_2PO(OH)_2]_2]_2$; and phosphorus acid $H_3PO_3$; and other similar organic phosphonates, and mixtures thereof.

The sequestrant can be or include aminocarboxylic acid type sequestrant. Suitable aminocarboxylic acid type sequestrants include the acids or alkali metal salts thereof, e.g., amino acetates and salts thereof. Some examples include the following:

N-hydroxyethylaminodiacetic acid;

hydroxyethylenediaminetetraacetic acid, nitrilotriacetic acid (NTA);

methylglycinediacetic acid (MGDA);

ethylenediaminetetraacetic acid (EDTA);

N-hydroxyethyl-ethylenediaminetriacetic acid (HEDTA);

diethylenetriaminepentaacetic acid (DTPA); and alanine-N,N-diacetic acid;

imidodisuccinic acid;

and the like; and mixtures thereof.

One useful builder/chelating agent or salt thereof includes a polymeric phosphinocarboxylic acid including salts thereof and derivatives thereof. Such materials can be prepared by reacting an unsaturated carboxylic acid monomer such as acrylic acid with a hypophosphorous acid or derivative thereof generally represented by the following formula:

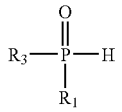

where $R_1$ is a group OX wherein X is hydrogen or a straight or branched alkyl group containing 1 to 4 carbon atoms; and $R_3$ is hydrogen, a straight or branched alkyl group of 1 to 8 carbon atoms, a cycloalkyl group of 5 to 12 carbon atoms, a phenyl group, a benzyl group or an —OX group wherein X is hydrogen or a straight or branched alkyl group of 1 to 4 carbon atoms. Salts of the polyphosphinocarboxylic acid can also be employed as noted. One preferred embodiment of such a material is Belsperse®-161.

The sequestrant can be or include a biodegradable sequestrant. Suitable biodegradable sequestrants include methyl glycine diacetic acid or its salts. Such a sequestrant is commercially available, for example, under the tradename Trilon ES.

Divalent Ion

The cleaning compositions of the invention can contain a divalent ion, such as calcium and magnesium ions, at a level of from 0.05% to 5% by weight, from 0.1% to 1% by weight, or about 0.25% by weight of the composition. In an embodiment, calcium ions can be included in the present compositions. The calcium ions can, for example, be added as a chloride, hydroxide, oxide, formate or acetate, or nitrate, preferably chloride, salt.

Polyol

The stabilized microbial or enzyme preparation or cleaning composition of the invention can also include a polyol. The polyol can, for example, provide additional stability and hydrotrophic properties to the composition. Suitable polyols include glycerin; glycols, such as ethylene glycol, propylene glycol, or hexylene glycol; sorbitol; alkyl polyglycosides; and mixtures thereof. In an embodiment, the polyol includes propylene glycol.

Suitable alkyl polyglycosides for use as polyols according to the invention include those with the formula:

$$(G)_x\text{-O—R}$$

in which G is a moiety derived from reducing saccharide containing 5 or 6 carbon atoms, e.g., pentose or hexose, R is a fatty aliphatic group containing 6 to 20 carbon atoms, and x is the degree of polymerization (DP) of the polyglycoside representing the number of monosaccharide repeating units in the polyglycoside. Preferably, x is about 0.5 to about 10. In an embodiment, R contains 10-16 carbon atoms and x is 0.5 to 3.

In an embodiment, the polyol can be in the form of a polyether. Suitable polyethers include polyethylene glycols. Suitable polyethers include those listed below as solvent or co-solvent.

In certain embodiments, the present composition includes about 2 to about 30 wt-% polyol, about 2 to about 10 wt-% polyol, about 5 to about 20 wt-% polyol, about 5 to about 10 wt-% polyol, or about 10 to about 20 wt-% polyol. In certain embodiments, the present stabilized microbial or enzyme preparations include about 2 to about 40 wt-% polyol, about 2 to about 20 wt-% polyol, about 2 to about 15 wt-% polyol, about 2 to about 10 wt-% polyol, about 3 to about 10 wt-% polyol, about 4 to about 15 wt-% polyol, or about 4 to about 8 wt-% polyol, about 4 wt-% polyol, about 8 wt-% polyol, or about 12 wt-% polyol. The composition can include any of these ranges or amounts not modified by about.

Solvent or Cosolvent

A solvent or cosolvent can be used to enhance certain soil removal properties of this invention. Preferred cosolvents are alcohols and the mono and di-alkyl ethers of alkylene glycols, dialkylene glycols, trialkylene glycols, etc. Alcohols which are useful as cosolvents in this invention include methanol, ethanol, propanol and isopropanol. Particularly useful in this invention are the mono and dialkyl ethers of ethylene glycol and diethylene glycol, which have acquired trivial names such as polyglymes, cellosolves, and carbitols. Representative examples of this class of cosolvent include methyl cellosolves, butyl carbitol, dibutyl carbitol, diglyme, triglyme, etc. Nonaqueous liquid solvents can be used for varying compositions of the present invention. These include the higher glycols, polyglycols, polyoxides and glycol ethers. Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), ethylene glycol n-butyl ether and ethylene glycol n-propyl ether. Other useful solvents are ethylene oxide/propylene oxide, liquid random copolymer such as Synalox® solvent series from Dow Chemical (e.g., Synalox® 50-SOB). Other suitable solvents are propylene glycol ethers such as PnB, DPnB and TPnB (propylene glycol mono n-butyl ether, dipropylene glycol and tripropylene glycol mono n-butyl ethers sold by Dow Chemical under the trade name Dowanol®). Also tripropylene glycol mono methyl ether "Dowanol TPM®" from Dow Chemical is suitable.

Suitable solvents to be used with this invention include non VOCs or low VOCs including DPnB, PnB, D-limonene, n-methylpyrrolidone, propylene glycol phenyl ether, ethylene glycol phenyl ether, tripropylene glycol methyl ether, and the like.

Acidulants

Acidulants or alkaline agents are used to maintain the appropriate pH for the cleaners of the invention. Careful pH control can enhance cleaning. The acidic component or acidulant used to prepare the cleaners of the invention will include an acid which can be dissolved in the aqueous system of the invention to adjust the pH downward. Preferably, common commercially-available weak inorganic and organic acids can be used in the invention. Useful weak inorganic acids include phosphoric acid and sulfamic acid. Useful weak organic acids include acetic acid, hydroxyacetic acid, citric acid, tartaric acid and the like. Acidulants found useful include organic and inorganic acids such as citric acid, lactic acid, acetic acid, glycolic acid, adipic acid, tartaric acid, succinic acid, propionic acid, maleic acid, alkane sulfonic acids, cycloalkane sulfonic acids, as well as phosphoric acid and the like or mixtures thereof.

Additional Sources of Alkalinity

Alkaline materials that can be used for pH adjustment include both weak and strong alkaline materials. Such materials include strong bases such as sodium hydroxide, potassium hydroxide, alkali metal salts such as sodium carbonate, potassium carbonate, sodium bicarbonate, potassium bicarbonate, sodium sesquicarbonate, sodium borate, potassium borate, sodium phosphate, and potassium phosphate, organic bases such as triethanolamine, tripropanolamine, etc., alkali metal silicates, alkali metal salts generally.

Additional sources of alkalinity can include potassium hydroxides or basic potassium salts such as potassium carbonate, potassium bicarbonate, potassium phosphate, etc.

Thickening or Gelling Agents

Suitable thickeners can include those that do not include components incompatible with food or other sensitive products in contact areas. In addition, the thickeners should not inhibit the growth of the spore of the present composition. Generally, thickeners which may be used in the present invention include natural gums such as xanthan gum, guar gum, modified guar, or other gums from plant mucilage; modified gums; polysaccharide based thickeners, such as alginates, starches, and cellulosic polymers (e.g., carboxymethyl cellulose, hydroxyethyl cellulose, and the like); polyacrylates thickeners; associative thickeners; and hydrocolloid thickeners, such as pectin. Generally, the concentration of thickener employed in the present compositions or methods will be dictated by the desired viscosity within the final composition. However, as a general guideline, the viscosity of thickener within the present composition ranges from about 0.05 wt-% to about 3 wt-%, from about 0.1 wt-% to about 2 wt-%, or about 0.1 wt-% to about 0.5 wt-%.

Dye

The composition of the invention can also include a dye. The dye advantageously provides visibility of the product in a package, dispenser, and/or lines to the composition. A wide variety of dyes are suitable, including Acid Green 25 and Direct Blue 86.

Use Compositions

The compositions and methods of the invention are suitable for removing complex organic or greasy soils and inorganic soils from a variety of substrates. The compositions of the invention can be used neat (i.e., without diluent such as an aqueous diluent) or can be diluted with water or other liquid medium to form a degreasing aqueous solution. Further, the degreasing compositions of the invention can be used as an additive with other formulated cleaning compositions for cleaning substrates.

The grease removing organic and inorganic soil cleaning compositions of the invention can be used as a grease removing additive for a formulated cleaning material. Such cleaning materials are common in the industry and include hard surface cleaners, laundry detergents, general purpose cleaners for use in household and institutional applications, floor cleaners, glass cleaners, etc. The compositions of the invention are used as an additive by adding to a conventional cleaner formulation about 0.1 to about 20 wt-% of the composition of the invention. The materials of this invention, even when strongly diluted in aqueous solution alone or in a formulation such as a glass cleaner, hard surface cleaner, general purpose cleaner, or laundry detergent, can provide exceptional grease removal that is as nearly effective as the concentrate material.

The compositions of the invention can be used full strength (neat, i.e. in the absence of an aqueous diluent). The compositions of the invention are directly applied to organic or greasy soils typically on a hard surface such as glass, metal, composite, wood, etc. surfaces. The compositions combined with the organic or greasy soils, tend to reduce any soil/hard surface interface bonding and reduce the cohesiveness of the complex soil and reduce the viscosity of the soil material, resulting in relative ease of physical removal.

A use composition can include any of the wt-% amounts of ingredients listed above divided by the amount of dilution, and can be expressed as wt-% or ppm. In particular, the amounts listed above for boric acid salt and microbial component or spore are for concentrate compositions. For example, a use composition can include any of the wt-% amounts listed above divided independently by 10, 20, 30, 40, 50, 60, 70, 80, 90, 100, 200, 300, 400, 500, 600, 700, 800, 900, 1000, 2000, 3000, 4000, 5000, 6000, 7000, 8000, 9000, or 10000. In an embodiment, the dilution is by a factor of 2 oz of concentrate to 1 gallon of use composition.

Foaming

In an embodiment, the present composition can be mixed with diluent to form a use composition that is used in a foamer. Foaming application can be accomplished, for example, using a foam application device such as a tank roamer or an aspirated wall mounted foamer, e.g., employing a foamer nozzle of a trigger sprayer. Foaming application can be accomplished by placing the use composition in a fifteen gallon foam application pressure vessel, such as a fifteen gallon capacity stainless steel pressure vessel with mix propeller. The foaming composition can then be dispensed through a foaming trigger sprayer. A wall mounted foamer can use air to expel foam from a tank or line. In an embodiment, compressed air can be injected into the mixture, then applied to the object through a foam application device such as a tank foamer or an aspirated wall mounted foamer.

Mechanical foaming heads that can be used according to the invention to provide foam generation include those heads that cause air and the foaming composition to mix and create a foamed composition. That is, the mechanical foaming head causes air and the foaming composition to mix in a mixing chamber and then pass through an opening to create a foam.

Suitable mechanical foaming heads that can be used according to the invention include those available from Airspray International, Inc. of Pompano Beach, Fla., and from Zeller Plastik, a division of Crown Cork and Seal Co. Suitable mechanical foaming heads that can be used according to the invention are described in, for example, U.S. Patent No. D-452,822; U.S. Patent No. D-452,653; U.S. Patent No. D-456,260; and U.S. Pat. No. 6,053,364. Mechanical foaming heads that can be used according to the invention includes those heads that are actuated or intended to be actuated by application of finger pressure to a trigger that causes the foaming composition and air to mix and create a foam. That is, a person's finger pressure can cause the trigger to depress thereby drawing the foaming composition and air into the head and causing the foaming composition and air to mix and create a foam.

Methods Employing the Present Compositions

In an embodiment, the cleaning composition is directly applied to a heavy soil deposit, permitted to soften and promote soil removal. Once the composition has been permitted to enhance the removability of the soil, the cleaner and removed soil can be readily removed with a rinse step. In an embodiment, the method omits rinsing. That is, the present composition can be applied and the surface is not rinsed. The compositions of the invention including a nonionic surfactant, a nonionic silicone surfactant, an anionic surfactant, and a hydrotrope can be directly contacted with the hard surface for the removal of organic, oily or greasy soils. Depending on substrate, such a composition can additionally include a chelating agent to have a final formulation including a nonionic surfactant and a nonionic silicone surfactant, an anionic surfactant, a hydrotrope solubilizer and a chelating agent. These compositions can be used on substantially non-corrosive surfaces such as plastics, wood, coated wood, stainless steels, composite materials, fabrics, cement, and others.

In an embodiment, the present method includes a method of cleaning a hard surface. The method can include applying to the surface a cleaning composition including spore or bacteria; borate salt; about 0.5 to about 35 wt-% nonionic surfactant; and about 0.1 to about 35 wt-% silicone surfactant. The method can include applying the composition to a floor, a drain, or a combination thereof.

In an embodiment, the present method includes a method of cleaning a floor. Such a method can include increasing the coefficient of friction of the floor. Such a method can include cleaning the grout of a tile floor. Cleaning grout can include allowing more of its natural color to show. The method includes applying a stabilized spore composition according to the present invention to the floor. In an embodiment, the method does not include (e.g., omits) rinsing. In an embodiment, the present method can include effectively removing from flooring (e.g., tile) a slippery-when-wet film. The method can include cleaning the flooring and increasing its coefficient of friction.

In an embodiment, the present method of cleaning a hard surface can include applying the present composition to a bathroom surface, such as a wall, floor, or fixture. The bathroom surface can be a shower wall or surface. The bathroom surface can be a tiled wall. A composition for use on a vertical surface can include a thickener, humectant, or foaming surfactant. Applying the composition to the vertical surface can include foaming the composition. In an embodiment, the present composition includes a thickener or humectant, which can assist in retaining the composition on a horizontal or vertical surface.

In an embodiment, the present method can include applying the present composition to a surface that has grease or oil on it. Such surfaces include a floor, a parking lot, a drive through pad, a garage floor, a parking ramp floor, and the like.

In an embodiment, the present method includes spraying or misting a surface with the present composition.

In an embodiment, the present method includes applying the stabilized microbial or enzyme composition to a surface and keeping the surface moist for an extended period, such as one or two hours up to about eight to about 16 hours. Keeping the surface moist can be accomplished by repeated application of the composition, such as by misting. Keeping the surface moist can be accomplished by contacting the surface with a sponge, rag, or mop wet with the composition for an extended period. Keeping the surface moist can be accomplished by applying a persistent stable microbial composition. A persistent stable microbial composition can remain on the surface and keep the surface moist. For example, a thickened composition and certain foamed compositions can remain on the surface and keep the surface moist. Extended presence of the present composition can provide more rapid cleaning compared to a composition that dries or evaporates.

The present compositions can be used for Deli, kitchen, restaurant and food preparation areas. It can also be used as a foam-on clean system for kitchens for equipment, floor and environmental cleaning. It can be used for fabric pre-treatment where fabric has time to be in contact with product to enhance removal of lipid type stains on natural and synthetic fabrics. Spotter for lipid removal from spun polyester and micro-fiber cloth. It can be used for pretreatment of meat cutting room to prevent entrainment of fat soils into porous substrates. It can be used for concrete pre-treatment in outdoor eating areas to prevent setting of grease and chocolate stains into porous concrete and stone surfaces.

The present invention may be better understood with reference to the following examples. These examples are intended to be representative of specific embodiments of the invention, and are not intended as limiting the scope of the invention.

EXAMPLES

Example 1

Borate Salts Stabilize Microbial Preparations

Compositions according to the present invention were demonstrated to stabilize microbial preparations, specifically a grease digesting spore composition.

Materials and Methods

This experiment evaluated aerobic plate counts produced from various cleaning compositions including bacterial spores, with and without aging of the compositions. Those compositions including viable spores produced bacterial colonies with lipolytic activity that resulted in dark zones in plated growth media. The dark zones resulted from production of free fatty acids. Controls included spores or bacteria suspended in water and a conventional bacterial cleaning compositions.

The test method was a standard protocol from "Lipolytic Microorganisms", *Compendium of Methods for the Microbiological Examination of Foods*, Third edition, 1992, p. 183. Briefly, lipolytic agar plates were prepared. The plates were inoculated with the test bacterial suspensions and allowed to dry. Nutrient agar was poured on the inoculated surface. The plates were incubated at room temperature to allow growth of bacteria and inspected for appearance of lipolytic colonies. Lipolytic colonies were identified by a surrounding dark blue zone.

The following compositions were made and tested in this Example:

| | 1 | 2 | 3 | 4 | 5 | 6 | 7 |
|---|---|---|---|---|---|---|---|
| Water | 26 | 28 | 28 | 30 | 54 | 56 | 56 |
| Boric acid | 10 | 10 | 10 | 10 | | | |
| Alkanol Amine | 19 | 19 | 19 | 19 | 2 | 2 | 2 |
| Polyol | 8 | 8 | 8 | 8 | 8 | 8 | 8 |
| Nonionic Surfactant | 8 | 8 | 8 | 8 | 8 | 8 | 8 |
| Silicone Surfactant | 3 | 3 | 3 | 3 | 3 | 3 | 3 |
| Amphoteric Surfactant | 5 | 5 | 5 | 5 | 5 | 5 | 5 |
| Anionic Surfactant | 8 | 8 | 8 | 8 | 8 | 8 | 8 |
| Hydrotrope | 11 | 11 | 11 | 11 | 11 | 11 | 11 |
| Spore Blend | 2 | 2 | | | 2 | | 2 |
| Protease | 2 | | 2 | | 2 | 2 | |

all amounts in wt-%

Control composition 8 included 2 wt-% spore blend in water. Control composition 9 included 2 wt-% protease in water. Control composition 10 included 2 wt-% spore blend and 2 wt-% protease in water.

Each composition was diluted to 2 wt-% for testing of bacterial growth.

Results

Tables 1-3 report the results of testing of the viability of the spore blend in the compositions described above, in control formulations, and in commercially available formulations.

TABLE 1

| (Formula Number) Description | Aerobic Lipolytic Plate Count (CFU/mL) |
|---|---|
| Water + 2% spore blend | $5.1 \times 10^4$ |
| Water + 2% protease | <1 |
| Water + 2% spore blend + 2% protease | $9.8 \times 10^3$ |
| (1) Amine borate + 2% spore blend + 2% protease | $4.7 \times 10^4$ |
| (2) Amine borate + 2% spore blend | $7.6 \times 10^4$ |
| (3) Amine borate + 2% protease | $1.7 \times 10^2$* |
| (4) Amine borate | <1 |

TABLE 1-continued

| (Formula Number) Description | Aerobic Lipolytic Plate Count (CFU/mL) |
|---|---|
| (5) No borate + 2% spore blend + 2% protease | $2.3 \times 10^4$ |
| (6) No borate + 2% protease | $1.3 \times 10^{2}$* |
| (7) No borate + 2% spore blend | $2.5 \times 10^4$ |

*= Cross contamination between samples.

TABLE 2

| (Formula Number) Description | Aerobic Plate Count Results (CFU/mL) |
|---|---|
| (1) Amine borate + 2% spore blend + 2% protease freshly made | $1.7 \times 10^4$ |
| (1) Amine borate + 2% spore blend + 2% protease aged 6 days | $2.1 \times 10^4$ |
| (5) No borate + 2% spore blend + 2% protease freshly made | $2.5 \times 10^4$ |
| (5) No borate + 2% spore blend + 2% protease aged 6 days | $2.0 \times 10^3$ |
| 2% Commercial spore blend containing cleaner of unknown age | $5.0 \times 10^2$ |
| 2% Commercial spore blend containing cleaner - 4 months old | $3.6 \times 10^3$ |
| Water + 2% spore blend | $3.0 \times 10^4$ |

TABLE 3

| (Formula Number) Description | Aerobic Plate Count Results (CFU/mL) |
|---|---|
| (1) Amine borate + 2% spore blend + 2% protease aged 10 weeks | $2.1 \times 10^4$ |
| (1) Amine borate + 2% spore blend + 2% protease aged 5 weeks | $1.4 \times 10^4$ |
| (1) Amine borate + 2% spore blend + 2% protease aged 4 weeks | $2.0 \times 10^4$ |
| (5) No borate + 2% spore blend + 2% protease aged 4 weeks | $1.3 \times 10^4$ |
| (5) No borate + 2% spore blend + 2% protease aged 5 weeks | $2.4 \times 10^3$ |
| Commercial 2 part spore containing floor cleaner freshly made concentrate | $3.8 \times 10^5$ |

Conclusions

Amine borate salts stabilize spores of grease-digesting bacteria and the bacteria themselves. Increased stability was observed for concentrate compositions including amine borate salts and spore blend. For example, a 6-day old sample of formula 5 (no borate) lost about one log bacterial activity. Unexpectedly, a 6-day old sample of formula 1, which included amine borate salt, maintained full bacterial activity. That is, it remained as active as a freshly prepared sample.

Degradation of bacterial activity in a commercial spore blend containing cleaner (which did not contain borate) was significant. The 4-month old sample had lost about one log bacterial activity. A sample of unknown age had lost about two log bacterial activity.

Unexpectedly, amine borate salts, which can have limited solubility, were soluble in compositions with silicone surfactants.

Example 2

Borate Salt Compositions Including Polyol Stabilize Microbial Preparations

Compositions according to the present invention and including both borate salt and polyol were demonstrated to stabilize microbial preparations, specifically a grease digesting spore composition.

Materials and Methods

Compositions were made according to the general formulas listed in Example 1 but with varying concentrations of borate counter ion (e.g., alkanolamine) and polyol (e.g., propylene glycol). The stability of the compositions was determined by measuring lipolytic activity at various times after the composition was made. The compositions generally contained 2 wt-% spore blend. Each composition was diluted to 2 wt-% for testing of bacterial growth, which was done as described in Example 1.

The following compositions were made and tested in this example.

| | 11 | 12 | 13 | 14 | 15 | 16 | 17 | 18 | 19 | 20 |
|---|---|---|---|---|---|---|---|---|---|---|
| Water | 50 | 44 | 38 | 31 | 48 | 36 | 58 | 55 | 49 | 43 |
| Boric acid | 2 | 4 | 6 | 8 | 4 | 8 | 2 | 4 | 6 | 8 |
| Alkanol Amine | 5 | 9 | 14 | 18 | 9 | 18 | 5 | 9 | 14 | 18 |
| Polyol | 8 | 8 | 8 | 8 | 4 | 4 | | | | |
| Nonionic Surfactant | 8 | 8 | 8 | 8 | 8 | 8 | 8 | 8 | 8 | 8 |
| Silicone Surfactant | 3 | 3 | 3 | 3 | 3 | 3 | 3 | 3 | 3 | 3 |
| Amphoteric Surfactant | 5 | 5 | 5 | 5 | 5 | 5 | 5 | 5 | 5 | 5 |
| Anionic Surfactant | 8 | 8 | 8 | 8 | 8 | 8 | 8 | 8 | 8 | 8 |
| Hydrotrope | 11 | 11 | 11 | 11 | 11 | 11 | 11 | 8 | 8 | 8 |
| Spore Blend | 2 | 2 | 2 | 2 | 2 | 2 | 2 | 2 | 2 | 2 |
| Protease | | | | 1 | | | | | | |
| pH 100% | 9.7 | 10 | 10.3 | 10.1 | 10.1 | 10.5 | 10.1 | 10 | 10.4 | 10.5 |
| pH 1% | 9.2 | 9.3 | 9.5 | 9.3 | 9.3 | 9.5 | 9.5 | 9.4 | 9.4 | 9.5 |

all amounts in wt-%

Results

Tables 4-8 report the results of testing of the viability of the spore blend in compositions 11-20.

TABLE 4

Unaged Compositions

| (Composition Number) Description | Aerobic Plate Count Results (CFU/mL) | Growth Reduction (Log) |
|---|---|---|
| (11) 2% Boric acid + 5% MEA + 8% Propylene glycol | $4.5 \times 10^4$ | NA |
| (12) 4% Boric acid + 9% MEA + 8% Propylene glycol | $3.0 \times 10^3$ | NA |
| (13) 6% Boric acid + 14% MEA + 8% Propylene glycol | $2.2 \times 10^4$ | NA |
| (14) 8% Boric acid + 18% MEA + 8% Propylene glycol | $2.0 \times 10^4$ | NA |
| (15) 4% Boric acid + 9% MEA + 4% Propylene glycol | $2.4 \times 10^4$ | NA |
| (16) 8% Boric acid + 18% MEA + 4% Propylene glycol | $2.8 \times 10^4$ | NA |
| (17) 2% Boric acid + 5% MEA | $5.4 \times 10^4$ | NA |
| (18) 4% Boric acid + 9% MEA | $5.0 \times 10^4$ | NA |
| (19) 6% Boric acid + 14% MEA | $2.7 \times 10^4$ | NA |
| (20) 8% Boric acid + 18% MEA | $3.4 \times 10^4$ | NA |

TABLE 5

Compositions Aged 4 Weeks

| (Composition Number) Description | Aerobic Plate Count Results (CFU/mL) | Growth Reduction (Log) |
|---|---|---|
| (11) 2% Boric acid + 5% MEA + 8% Propylene glycol | $2.2 \times 10^5$ | — |
| (12) 4% Boric acid + 9% MEA + 8% Propylene glycol | $9.4 \times 10^4$ | — |
| (13) 6% Boric acid + 14% MEA + 8% Propylene glycol | $1.2 \times 10^5$ | — |
| (14) 8% Boric acid + 18% MEA + 8% Propylene glycol | $1.2 \times 10^5$ | — |
| (15) 4% Boric acid + 9% MEA + 4% Propylene glycol | $3.2 \times 10^5$ | — |
| (16) 8% Boric acid + 18% MEA + 4% Propylene glycol | $1.0 \times 10^5$ | — |
| (17) 2% Boric acid + 5% MEA | $1.9 \times 10^5$ | — |
| (18) 4% Boric acid + 9% MEA | $2.5 \times 10^4$ | 0.3 |
| (19) 6% Boric acid + 14% MEA | $4.8 \times 10^4$ | — |
| (20) 8% Boric acid + 18% MEA | $1.0 \times 10^5$ | — |

TABLE 6

Compositions Aged 8 Weeks

| (Composition Number) Description | Aerobic Plate Count Results (CFU/mL) | Growth Reduction (Log) |
|---|---|---|
| (11) 2% Boric acid + 5% MEA + 8% Propylene glycol | $2.1 \times 10^4$ | 0.33 |
| (12) 4% Boric acid + 9% MEA + 8% Propylene glycol | $3.0 \times 10^4$ | — |
| (13) 6% Boric acid + 14% MEA + 8% Propylene glycol | $2.2 \times 10^3$ | 1.0 |
| (14) 8% Boric acid + 18% MEA + 8% Propylene glycol | $3.4 \times 10^4$ | — |
| (15) 4% Boric acid + 9% MEA + 4% Propylene glycol | $3.3 \times 10^4$ | — |
| (16) 8% Boric acid + 18% MEA + 4% Propylene glycol | $1.3 \times 10^4$ | 0.33 |
| (17) 2% Boric acid + 5% MEA | $1.8 \times 10^4$ | 0.48 |
| (18) 4% Boric acid + 9% MEA | $2.7 \times 10^4$ | 0.27 |

TABLE 6-continued

Compositions Aged 8 Weeks

| (Composition Number) Description | Aerobic Plate Count Results (CFU/mL) | Growth Reduction (Log) |
|---|---|---|
| (19) 6% Boric acid + 14% MEA | $5.0 \times 10^3$ | 0.72 |
| (20) 8% Boric acid + 18% MEA | $6.0 \times 10^3$ | 0.75 |

TABLE 7

Compositions Aged 12 Weeks

| (Composition Number) Description | Aerobic Plate Count Results (CFU/mL) | Growth Reduction (Log) |
|---|---|---|
| (11) 2% Boric acid + 5% MEA + 8% Propylene glycol | $1.1 \times 10^4$ | 0.61 |
| (12) 4% Boric acid + 9% MEA + 8% Propylene glycol | $5.2 \times 10^3$ | — |
| (13) 6% Boric acid + 14% MEA + 8% Propylene glycol | $5.4 \times 10^2$ | 1.61 |
| (14) 8% Boric acid + 18% MEA + 8% Propylene glycol | $1.4 \times 10^2$ | 2.15 |
| (15) 4% Boric acid + 9% MEA + 4% Propylene glycol | $6.8 \times 10^3$ | 0.55 |
| (16) 8% Boric acid + 18% MEA + 4% Propylene glycol | $1.5 \times 10^1$ | 3.27 |
| (17) 2% Boric acid + 5% MEA | $2.4 \times 10^3$ | 1.35 |
| (18) 4% Boric acid + 9% MEA | $3.2 \times 10^3$ | 1.19 |
| (19) 6% Boric acid + 14% MEA | $5.1 \times 10^2$ | 1.72 |
| (20) 8% Boric acid + 18% MEA | $<1 \times 10^1$ | 3.53 |

TABLE 8

Compositions Aged 16 Weeks

| (Composition Number) Description | Aerobic Plate Count Results (CFU/mL) | Growth Reduction (Log) |
|---|---|---|
| (11) 2% Boric acid + 5% MEA + 8% Propylene glycol | $6.2 \times 10^3$ | 0.86 |
| (12) 4% Boric acid + 9% MEA + 8% Propylene glycol | $2.0 \times 10^3$ | 0.18 |
| (15) 4% Boric acid + 9% MEA + 4% Propylene glycol | $5.8 \times 10^2$ | 1.62 |

Conclusions:

Only minor reductions in the growth of bacteria occurred upon aging of the compositions for up to 8 weeks. More significant reductions in growth of bacteria were observed after 12 weeks of aging. For example, growth of bacteria was reduced by greater than or equal to one log for composition numbers 13, 14, 16, 17, 18, 19 and 20. That means that composition numbers II, 12, and 15 exhibited the greatest stabilization after 12 weeks of aging. These results confirm that borate salts (e.g., alkanol amine borate salts) stabilize the spore blend.

Interestingly, each of the compositions lacking polyol showed a reduction of more than one log. This indicates that polyol contributes to stabilizing the spore blend.

Interestingly, the present compositions stabilized the spore blend even at pH above 9.5, at pH 10, and even at pH 10.5. For example, composition 12 stabilized the spore blend up to 16 weeks at a pH of about 10.

Example 3

Borate Salt Compositions Stabilize Microbial preparations at Basic pH

Compositions according to the present invention and including both borate salt and polyol were demonstrated to stabilize microbial preparations, specifically a grease digesting spore composition, over a wide range of basic pH.

Materials and Methods

Compositions were made according to the general formulas listed in Example 1 but with varying pH. The stability of the compositions was determined by measuring lipolytic activity at various times after the composition was made. The compositions generally contained 2 wt-% spore blend. Each composition was diluted to 2 wt-% for testing of bacterial growth, which was done as described in Example 1.

The following compositions were made and tested in this example.

| | 21 (pH 7) | 22 (pH 7.5) | 23 (pH 8) | 24 (pH 8.5) | 25 (pH 9) |
|---|---|---|---|---|---|
| Water | 55 | 55 | 54 | 53 | 53 |
| Boric acid | 4 | 4 | 4 | 4 | 4 |
| Alkanol amine | 2 | 2.5 | 3 | 4 | 4.5 |
| Polyol | 4 | 4 | 4 | 4 | 4 |
| Nonionic Surfactant | 8 | 8 | 8 | 8 | 8 |
| Silicone Surfactant | 3 | 3 | 3 | 3 | 3 |
| Amphoteric Surfactant | 5 | 5 | 5 | 5 | 5 |
| Anionic Surfactant | 8 | 8 | 8 | 8 | 8 |
| Hydrotrope | 11 | 11 | 11 | 11 | 11 |
| Spore Blend | 2 | 2 | 2 | 2 | 2 |

all amounts in wt-%

Results

Tables 9 and 10 report the results of testing of the viability of the spore blend in compositions 21-25.

TABLE 9

Lipolytic Microbial Counts (CFU/mL) - Average of Duplicate Plates

| Composition | Unaged | Aged 4 Weeks | Aged 8 Weeks | Aged 14 Weeks | 14 Week (24 Hour)* |
|---|---|---|---|---|---|
| 21 pH 7 | $1.9 \times 10^4$ | $4.4 \times 10^3$ | $1.4 \times 10^3$ | $1.3 \times 10^3$ | $1.8 \times 10^3$ |
| 22 pH 7.5 | $3.2 \times 10^3$ | $7.8 \times 10^3$ | $5.4 \times 10^2$ | $1.3 \times 10^3$ | $1.2 \times 10^3$ |
| 23 pH 8 | $1.2 \times 10^3$ | $7.4 \times 10^3$ | $2.6 \times 10^3$ | $2.0 \times 10^3$ | $2.1 \times 10^3$ |
| 24 pH 8.5 | $2.0 \times 10^4$ | $7.5 \times 10^3$ | $1.2 \times 10^3$ | $1.4 \times 10^3$ | $9.0 \times 10^2$ |
| 25 pH 9 | $2.1 \times 10^3$ | $1.4 \times 10^4$ | $2.4 \times 10^3$ | $1.7 \times 10^3$ | $2.0 \times 10^3$ |

*concentrate aged 14 weeks, diluted use composition aged 24 hours

TABLE 10

Reduction in Growth After Aging (log units)

| Composition | Unaged | Aged 4 Weeks | Aged 8 Weeks | Aged 14 Weeks | 14 Week (24 Hour)* |
|---|---|---|---|---|---|
| 21 pH 7 | NA | — | 0.13 | 0.16 | 0.02 |
| 22 pH 7.5 | NA | — | 0.77 | 0.39 | 0.42 |

TABLE 10-continued

Reduction in Growth After Aging (log units)

| Composition | Unaged | Aged 4 Weeks | Aged 8 Weeks | Aged 14 Weeks | 14 Week (24 Hour)* |
|---|---|---|---|---|---|
| 23 pH 8 | NA | — | — | — | — |
| 24 pH 8.5 | NA | 0.43 | 1.22 | 1.15 | 1.35 |
| 25 pH 9 | NA | — | — | 0.09 | 0.02 |

*concentrate aged 14 weeks, diluted use composition aged 24 hours

Conclusions

For at least about 14 weeks of aging the present compositions including borate salt and polyol provided effective stability for the spore blend at pH from 7 to 9.

Example 4

Stabilized Microbial Compositions with Added Lipase

Compositions according to the present invention and including borate salt, polyol, and lipase were made and shown to be stable and effective cleaners (compositions 26 and 27). These lipase containing compositions included and additional lipase containing compositions (28-31) can include ingredients in the following amounts:

| | 26 | 27 | 28 | 29 | 30 | 31 | 32 | 33 |
|---|---|---|---|---|---|---|---|---|
| Water | 27 | 64 | 60 | 56 | 52 | 48 | 64 | 52 |
| Boric acid | 10 | 5 | 5 | 5 | 5 | 5 | 5 | 5 |
| Alkanol amine | 18 | 9 | 9 | 9 | 9 | 9 | 9 | 8 |
| Polyol | 8 | 4 | 8 | 12 | 16 | 20 | 4 | 12 |
| Nonionic Surfactant | 8 | 4 | 4 | 4 | 4 | 4 | 4 | 4 |
| Silicone Surfactant | 3 | 1 | 1 | 1 | 1 | 1 | 1.3 | 1.3 |
| Amphoteric Surfactant | 5 | 3 | 3 | 3 | 3 | 3 | 3 | 3 |
| Anionic Surfactant | 8 | 4 | 4 | 4 | 4 | 4 | 4 | 4 |
| Hydrotrope | 11 | 3 | 3 | 3 | 3 | 3 | 5 | 5 |
| Sequestrant | | | | | | | | 4 |
| Spore Blend | 2 | 1 | 1 | 1 | 1 | 1 | 1 | 1 |
| Lipase | 2 | 1 | 1 | 1 | 1 | 1 | 1 | 2 |

all amounts in wt-%

Example 5

Stabilized Microbial Compositions Increase Slip Resistance of Floors

Compositions according to the present invention and including borate salt, polyol, and lipase were shown to be effective for significantly increasing slip resistance of a tile floor.

Materials and Methods

A use dilution including composition 33 (2 oz/gal or 1.6% of concentrate) was applied each day to a tile floor, specifically a quarry tile floor, without rinsing. Dry and wet slip resistance measurements were taken over a 6-week period in kitchens of 5 restaurants. The 6 weeks included 2 weeks for baseline measurements and 4 weeks or measurements after application of composition 33. Before cleaning with the present composition (e.g., during the baseline period and before), the floor was cleaned daily with a conventional, commercially available floor cleaning composition.

Slip resistance was measured as coefficient of friction (COF) using an English XL Variable Incidence Tribometer according to ASTM F1679-02. The protocol was as follows. Fifteen quarry tiles were selected in each restaurant kitchen. In the main walking pathways and areas of concern (e.g., near fryers) every $5^{th}$ tile was selected. The same 15 tiles in each restaurant were evaluated for COF each week. The COF of each tile was measured 4 times, once in each of 4 directions separated by 90°. Each tile was measured both wet and dry. The 60 measurements under each condition were averaged for each restaurant, and the results for the 5 restaurants were averaged.

Results

The COF of dry tile improved from an average baseline value of 0.60 to 0.81 through the 4-week test period. The COF of wet tile improved from an average baseline value of 0.38 to 0.56 through the 4-week test period. Each of these increases is significant with a confidence level exceeding 99%.

Conclusion

Compositions according to the present invention significantly increase coefficients of friction for slippery surfaces, such as floors in restaurant kitchens.

Example 6

Stabilized Microbial Compositions Clean Grout

Compositions according to the present invention and including borate salt, polyol, and lipase were shown to be effective for cleaning grout between tiles.

Materials and Methods

A use dilution of composition 33 (2 oz/gal or 1.6% of concentrate) was applied to a tile floor, specifically a quarry tile floor, without rinsing, as described in Example 5. The tile was photographed before and after application of the present composition.

Results

The present composition cleaned grout on a quarry tile floor in a restaurant kitchen. Composition 33 cleaned the grout, the conventional composition did not.

Conclusions

The present compositions clean tile grout more effectively than conventional compositions.

Example 7

Stabilized Microbial Compositions Clean Floors

Compositions according to the present invention and including borate salt, polyol, and spore were shown to be effective for cleaning floors.

Materials and Methods

A use dilution of composition 34 (2 oz/gal or 1.6% of concentrate) was applied to a tile floor, specifically a quarry tile floor, without rinsing. The floor was evaluated before and after application of the present composition.

| | 34 |
|---|---|
| Water | 43 |
| Boric acid | 10 |
| Alkanol amine | 19 |

-continued

| | 34 |
|---|---|
| Polyol | 5 |
| Nonionic Surfactant | 5 |
| Silicone Surfactant | 2 |
| Amphoteric Surfactant | 3 |
| Anionic Surfactant | 5 |
| Hydrotrope | 7 |
| Spore Blend | 1 |

all amounts in wt-%

Results

Composition 34 cleaned the floor.

Conclusions

The present compositions clean floors more effectively than conventional compositions.

Example 8

Stabilized Enzyme Compositions Including Antimicrobial Agent

Compositions according to the present invention and including antimicrobial agent (e.g., ether amine), borate salt, polyol, and enzyme were shown to be effective for antimicrobial (e.g., sanitizing) action in a non-food contact sanitizing test. The composition produced greater than 3 $\log_{10}$ reduction of bacteria within a 5 minute contact time.

| | Composition (wt-%) | | | | |
|---|---|---|---|---|---|
| Ingredient | 1 | 2 | 3 | 4 | 5 |
| Water | 69 | 62 | 58 | 62 | 62 |
| bis (3-aminopropyl)dodecylamine | — | — | 2 | — | — |
| Dodecyl/tetradecyloxypropyl-1,3-diaminopropane | 3.0 | 3.0 | — | — | — |
| linear alkyloxypropyl amine | — | — | — | 3.0 | — |
| isotridecyloxypropyl-1,3-diaminopropane | — | — | — | — | 3.0 |
| Propylene Glycol | 7.0 | 12 | 12 | 12 | 12 |
| Boric Acid | 5.0 | 5.0 | 5.0 | 5.0 | 5.0 |
| monoethanolamine | 2.1 | 2.0 | 6.9 | 2.5 | 2.1 |
| ethylenediaminetetraacetic acid | 3.7 | 3.7 | 3.6 | 3.7 | 3.7 |
| first polyether siloxane | 0.50 | — | 0.50 | — | — |
| second polyether siloxane | 0.75 | — | 0.75 | — | — |
| Lauryl Dimethyl Amine Oxide 30 | 3.8 | 3.8 | 3.7 | 3.7 | 3.8 |
| Dicarboxylic coconut derivative sodium salt 40 | 2.5 | 2.5 | 2.5 | 2.6 | 2.5 |
| secondary alcohol 7 mole ethoxylate | 1.0 | 3.8 | 3.7 | 3.7 | 3.8 |
| lipase | 2.0 | 2.0 | 2.0 | 2.0 | 2.0 |
| pH | 7.2 | 7.0 | 9.2 | 7.0 | 7.0 |

The pH of Formula 3 was lowered to 7. Formulas 4 and 5 maintained enzyme stability at 40 C for at least 30 days. Formula 3 maintained enzyme stability at 40 C for 30 days, but dropped thereafter. Enzyme stability testing was performed according to the manufacturers specifications (e.g., Novozymes LUNA # 2000-10340-01 "Manual Procedure for Determination of Lipolase Activity in Enzyme Preparations and Detergents.")

| Chemical Name | Composition (wt-%) 6 | 7 |
|---|---|---|
| Water | 62 | 62 |
| Aliphatic amine | — | 3.0 |
| cocodiaminopropane | 3.0 | — |
| Propylene Glycol | 12 | 12 |
| Boric Acid | 5.0 | 5.0 |
| monoethanolamine | 2.1 | 2.3 |
| ethylenediaminetetraacetic acid | 3.8 | 3.8 |
| Lauryl Dimethyl Amine Oxide 30% | 3.8 | 3.7 |
| Dicarboxylic coconut derivative sodium salt 40% | 2.5 | 2.5 |
| secondary alcohol 7 mole ethoxylate | 3.7 | 3.7 |
| lipase | 2.0 | 2.0 |
| pH | 7.0 | 7.2 |

A summary of sanitizing efficacy in a non-food contact sanitizing test is shown below in Table 11 below. All testing was performed in 500 ppm synthetic hard water with a five minute exposure time. Microbiological testing was performed according to known methods, certain of which included EPA efficacy data requirements from DIS/TSS-10.

TABLE 11

Antimicrobial Activity of Compositions 1-7

| Formula | pH | Log Reduction *S. aureus* 1.5 oz/1 gal | Log Reduction *S. aureus* 2.0 oz/1 gal | Log Reduction *E. aerogenes* 1.5 oz/1 gal | Log Reduction *E. aerogenes* 2.0 oz/1 gal |
|---|---|---|---|---|---|
| 1 | 7.2 | — | >4.81 | — | 3.82 |
| 2 | 7.0 | 5.50* | 4.85* | >4.94* | 4.47* |
| 3 | 9.2 | — | 4.88 | — | 4.29 |
| 4 | 7.1 | 4.12 | — | 2.65 | 5.17 |
| 5 | 7 | 3.90* | 3.33* | 3.90* | >4.94* |
| 6 | 7.2 | 2.66 | 3.25 | 2.74 | 3.81 |
| 7 | 7.2 | >4.87 | >5.00 | 3.31 | >5.40 |

*solutions were tested in the presence of 5% fetal bovine serum

A summary of physical stability of each formula is shown in Table 12 below.

TABLE 12

Physical Stability of Compositions 1–7

| Formula | Active Ingredient | Stability |
|---|---|---|
| 1 | Dodecyl/tetradecyloxypropyl-1,3-diaminopropane (DA 1618) | stable/has sanitizing efficacy |
| 2 | Dodecyl/tetradecyloxypropyl-1,3-diaminopropane (DA 1618) | stable/has sanitizing efficacy |
| 3 | bis (3-aminopropyl)dodecylamine (Lonzabac 12.30) | stable/has sanitizing efficacy |
| 4 | linear alkyloxypropyl amine (PA-19) | stable/has sanitizing efficacy |
| 5 | isotridecyloxypropyl-1,3-diaminopropane (DA-17) | stable/has sanitizing efficacy |
| 7 | Aliphatic amine (Tallow Tetramine) | stable/has sanitizing efficacy |
| 6 | cocodiaminopropane (Duomeen CD) | stable/has sanitizing efficacy |

A summary of stability and sanitizing efficacy for these compositions including an amine antimicrobial agent is shown below in Table 13. This table also includes, for comparison, results for compositions including other types of antimicrobial agents.

TABLE 13

Antimicrobial Activity, Physical Stability, and Enzyme Stability of Amine Antimicrobial Compositions

| Antimicrobial (tradename) | Physical Stability | Enzyme Stability | Antimicrobial Activity (log reduction) |
|---|---|---|---|
| dodecyl/tetradecyloxypropyl-1,3-diaminopropane (DA 1618) | yes | yes | 4.8 |
| isotridecyloxypropyl-1,3-diaminopropane (DA-17) | yes | yes | 4 |
| linear alkyloxypropyl amine (PA-19) | yes | yes | 4 |
| bis (3-aminopropyl)dodecylamine (Lonzabac 12.30) | yes | yes | 4.5 |
| aliphatic amine (tallow tetramine) | yes | yes | 4 |
| Cocodiaminopropane (Duomeen CD) | yes | yes | 2.5 |
| Chloroxylenol (PCMX) | yes | | na |
| 1,3-benzenediol (Resorcinol) | yes | | na |
| polyhexymethylene biguamde (Vantocil) | yes | | na |
| didecyl dimethyl ammonium chloride (Bardac 2250) | | | 3 |
| Hydroxymethylglycinate (Integra 44) | yes | | none |
| tetrakis(hydroxymethyl) phosphonium sulfate (Tolcide PS75) | | | na |

The amine antimicrobial agents provided antimicrobial activity (even sanitizing efficacy) while maintaining physical and enzymatic stability. The other antimicrobial agents tested failed to provide at least one of these advantageous features.

Additional antimicrobial testing was conducted as summarized in Table 14 below. The compositions were as described for compositions 1-7 above with respect to their ingredients but with different amine antimicrobial agents as listed by tradename. Chemical names can be found in the Table above.

TABLE 14

Activity of Amine Antimicrobial Compositions

| Formula | Amine | pH | Log Reduction *S. aureus* 1.5 oz/1 gal | Log Reduction *S. aureus* 2.0 oz/1 gal | Log Reduction *E. aerogenes* 1.5 oz/1 gal | Log Reduction *E. aerogenes* 2.0 oz/1 gal |
|---|---|---|---|---|---|---|
| 8 | 6.01% DA 1618 | 7.02 | | >4.81 | | >4.16 |
| 9 | 2.99% DA 1618 | 7.02 | | >4.81 | | 3.01 |
| 10 | 5.97% DA 1618 | 6.90 | | 3.46 | | 3.6 |
| 11 | 9.17% DA 1618 | 7.08 | | 4.61 | | >4.16 |
| 12 | 6.07% DA 1618 | 6.94 | | 4.61 | | >4.16 |
| 1 | 3.03% DA 1618 | 7.20 | | >4.81 | | 3.82 |
| 13 | 3.97% DA 1618 | 7.00 | | 4.83 | | >5.81 |
| 14 | 3.90% DA 1618 | 9.00 | | >5.26 | | 4.30 |
| 15 | 1.97% DA 1618 | 9.17 | | 4.98 | | 2.90 |
| 2 | 3.00% DA 1618 | 7.01 | 5.50* | 4.85* | >4.94* | 4.47* |
| 3 | 1.97% Lonzabac 12.30 | 9.15 | | 4.88 | | 4.29 |
| 16 | 3.94% Lonzabac 12.30 | 9.10 | | >5.26 | | 5.03 |
| 4 | 2.99% PA-19 | 7.07 | 4.12 | 5.12 | 2.65 | 5.17 |
| 17 | 3.01% PA-1816 | 7.05 | 4.10 | 4.80 | 4.10 | 4.06 |
| 5 | 2.99% DA-17 | 7.00 | 3.90* | 3.33* | 3.90* | >4.94* |
| 18 | 2.99% DA-18 | 7.00 | 3.70 | 3.48 | 3.16 | 4.37 |
| 19 | 2.99% DA-1214 | 7.21 | <1.57 | <1.42 | >4.64 | >4.64 |
| 20 | 3.01% DA-14 | 7.12 | 1.72 | 2.54 | >4.64 | >4.64 |
| 21 | 2.99% Tallow Triamine | 7.23 | 2.87 | 2.58 | 4.68 | 4.61 |
| 7 | 3.02% Tallow Tetramine | 7.15 | 2.66 | 3.25 | 2.74 | 3.81 |

TABLE 14-continued

Activity of Amine Antimicrobial Compositions

| Formula | Amine | pH | Log Reduction *S. aureus* 1.5 oz/1 gal | Log Reduction *S. aureus* 2.0 oz/1 gal | Log Reduction *E. aerogenes* 1.5 oz/1 gal | Log Reduction *E. aerogenes* 2.0 oz/1 gal |
|---|---|---|---|---|---|---|
| 22 | 3.00% Duomeen OL | 6.97 | 4.54 | 3.95 | 2.62 | 2.99 |
| 6 | 3.00% Duomeen CD | 7.21 | >4.87 | >5.00 | 3.31 | >5.40 |

All testing was conducted in 500 ppm synthetic hard water at room temperature (22 ± 2° C.) with a five minute exposure time.

*Solutions were tested in the presence of 5% fetal bovine serum.

Example 9

Stabilized Enzyme Cleaning and Antimicrobial Compositions

Compositions according to the present invention and including amine antimicrobial agent (e.g., ether amine), borate salt, polyol, and enzyme were shown to be effective for antimicrobial (e.g., sanitizing) action in a non-food contact sanitizing test. The compositions also provided moderate to superior cleaning (e.g., soil removal in a field test).

The following table show examples of antimicrobial formulas that also exhibit increased cleaning performance, as rated by the cleaning scale listed.

| Ingredient | Composition (wt-%) A | B | C | D | E | F |
|---|---|---|---|---|---|---|
| Soft Water | 64 | 70 | 60 | 59 | 57 | 61 |
| DA 1618 | | 3.0 | 3.0 | | | |
| Lonzabac 12.30 | | | | 2.0 | 2.0 | 2.0 |
| Glacial Acetic Acid | | | 1.0 | | | 1.0 |
| Propylene Glycol | 12 | 7.0 | 12 | 12 | 12 | 12 |
| Boric Acid | 5.0 | 5.0 | 5.0 | 5.0 | 5.0 | 5.0 |
| MEA | 3.5 | 2.2 | 3.3 | 7.1 | 7.0 | 3.4 |
| EDTA Acid | 3.8 | 3.8 | 3.8 | 3.8 | 3.7 | 3.7 |
| Silicone Surfactant | | | | | 1.3 | |
| Amine oxide | 3.8 | 3.8 | 3.8 | 3.8 | 3.8 | 3.8 |
| Amphoteric Surfactant | 2.5 | 2.5 | 2.5 | 2.5 | 2.5 | 2.5 |

-continued

| Ingredient | Composition (wt-%) A | B | C | D | E | F |
|---|---|---|---|---|---|---|
| Nonionic Surfactant | 3.8 | 1.0 | 3.8 | 3.8 | 3.8 | 3.8 |
| Lipase | 2.0 | 2.0 | 2.0 | 2.0 | 2.0 | 2.0 |
| Fragrance | 0.1 | 0.4 | 0.1 | 0.1 | | 0.1 |
| pH | 7 | 7 | 7 | 9 | 9 | 7 |

TABLE 15

Activity of Amine Antimicrobial Compositions A-F
Antimicrobial Activity (log reduction, 2 oz/gal)

| | A | B | C | D | E | F |
|---|---|---|---|---|---|---|
| *Staphylococcus aureus* | na | 4.9 | 2.8 | na | 4.9 | none |
| *Enterobacter aerogenes* | na | 4.5 | >5.6 | na | 4.3 | 3.6 |

TABLE 16

Cleaning by Amine Antimicrobial Compositions A-F

| A | B | C | D | E | F |
|---|---|---|---|---|---|
| 3 | 2.5 | 2.5 | 3 | NA | 2 |

1 = poor soil removal
2 = moderate soil removal
3 = superior soil removal

The ether amine antimicrobial agents provided antimicrobial activity (even sanitizing efficacy), superior cleaning, physical stability, and enzymatic stability.

Soil removal was determined in field tests of cleaning in restaurant kitchens. Visual inspection and measurement of the coefficient of friction were employed to rate the soil removal as poor, moderate, or superior and results were averaged. Antimicrobial testing and enzyme stability testing were performed as described in Example 8.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

All publications and patent applications in this specification are indicative of the level of ordinary skill in the art to which this invention pertains.

The invention has been described with reference to various specific and preferred embodiments and techniques. However, it should be understood that many variations and modifications may be made while remaining within the spirit and scope of the invention.

We claim:

1. A method of cleaning a hard surface, comprising applying to the surface a cleaning composition comprising:

spore, bacteria, fungi, or enzyme;

borate salt;

an amine antimicrobial agent of the formula:

$$[(R^1)NH(R^2)NH_3]^+(CH_3COO)^-,$$

wherein $R^1$ is C10-C18 aliphatic group or an ether group having the formula $R^{10}OR^{11}$;

in which $R^{10}$ is a C10-C18 aliphatic group and $R^{11}$ is a C1-C5 alkyl group; and $R^2$ is a C1-C5 alkylene group;

nonionic surfactant; and, optionally, about 0.1 to about 35 wt-% silicone surfactant, wherein the composition provides greater than 3 $\log_{10}$ reduction of bacteria within a 5 minute contact time.

2. A method of increasing the coefficient of friction of a hard surface, comprising applying to the surface a cleaning composition comprising:

spore, bacteria, fungi, or enzyme;

borate salt;

an amine antimicrobial agent of the formula:

$$[(R^1)NH(R^2)NH_3]^+(CH_3COO)^-,$$

wherein $R^1$ is C10-C18 aliphatic group or an ether group having the formula $R^{10}OR^{11}$;

in which $R^{10}$ is a C10-C18 aliphatic group and $R^{11}$ is a C1-C5 alkyl group; and $R^2$ is a C1-C5 alkylene group;

nonionic surfactant; and, optionally, about 0.1 to about 35 wt-% silicone surfactant, wherein the composition provides greater than 3 $\log_{10}$ reduction of bacteria within a 5 minute contact time.

3. A method of cleaning grout, comprising applying to the grout a cleaning composition comprising:

spore, bacteria, fungi, or enzyme;

borate salt;

an amine antimicrobial agent of the formula:

$$[(R^1)NH(R^2)NH_3]^+(CH_3COO)^-,$$

wherein $R^1$ is C10-C18 aliphatic group or an ether group having the formula $R^{10}OR^{11}$;

in which $R^{10}$ is a C10-C18 aliphatic group and $R^{11}$ is a C1-C5 alkyl group; and $R^2$ is a C1-C5 alkylene group;

nonionic surfactant; and, optionally, about 0.1 to about 35 wt-% silicone surfactant, wherein the composition provides greater than 3 $\log_{10}$ reduction of bacteria within a 5 minute contact time.

* * * * *